US009436133B2

(12) United States Patent
Tatsuura et al.

(10) Patent No.: US 9,436,133 B2
(45) **Date of Patent: *Sep. 6, 2016**

(54) IMAGE FORMING APPARATUS USING A DEVELOPER WITH A SOLUBILITY PARAMETER

(71) Applicant: FUJI XEROX CO., LTD., Tokyo (JP)

(72) Inventors: Satoshi Tatsuura, Kanagawa (JP); Yutaka Nogami, Kanagawa (JP); Keitaro Mori, Kanagawa (JP); Yoshihiro Inaba, Kanagawa (JP); Takako Kobayashi, Kanagawa (JP); Daisuke Yoshino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/254,200

(22) Filed: Apr. 16, 2014

(65) Prior Publication Data

US 2015/0104215 A1 Apr. 16, 2015

(30) Foreign Application Priority Data

Oct. 11, 2013 (JP) ..... 2013-213894

(51) Int. Cl.
*G03G 15/10* (2006.01)
*G03G 15/20* (2006.01)

(52) U.S. Cl.
CPC ..... *G03G 15/10* (2013.01); *G03G 15/2014* (2013.01)

(58) Field of Classification Search
CPC ..... G03G 15/10; G03G 15/2014
USPC ..... 399/237, 327
See application file for complete search history.

(56) References Cited

U.S. PATENT DOCUMENTS

| | | | | |
|---|---|---|---|---|
| 7,432,033 | B2 * | 10/2008 | Chou et al. | 430/137.22 |
| 2002/0159801 | A1 | 10/2002 | Nakashima et al. | |
| 2007/0231027 | A1 * | 10/2007 | Kamei et al. | 399/329 |
| 2007/0292174 | A1 * | 12/2007 | Klymachyov et al. | 399/327 |
| 2009/0148785 | A1 * | 6/2009 | Yogome | G03G 9/12 430/112 |
| 2012/0020706 | A1 * | 1/2012 | Yoshida et al. | 399/320 |
| 2014/0242512 | A1 * | 8/2014 | Tatsuura et al. | 430/112 |
| 2014/0242513 | A1 * | 8/2014 | Tatsuura et al. | 430/112 |

FOREIGN PATENT DOCUMENTS

| | | |
|---|---|---|
| JP | A-2001-092262 | 4/2001 |
| JP | A-2001-305868 | 11/2001 |
| JP | A-2003-167456 | 6/2003 |

* cited by examiner

*Primary Examiner* — Benjamin Schmitt
*Assistant Examiner* — Matthew Miller
(74) *Attorney, Agent, or Firm* — Oliff PLC

(57) ABSTRACT

An image forming apparatus includes an electrostatic latent image holding member, a charging device, a latent image forming device, a developing device that stores a liquid developer containing a toner and a non-volatile carrier liquid, and develops the electrostatic latent image formed on the surface of the electrostatic latent image holding member by the liquid developer to form a toner image, a transfer device that transfers the toner image onto a surface of an impermeable recording medium, and a fixing device, wherein when the SP value of the toner is set as SP(t), the SP value of the non-volatile carrier liquid is set as SP(c), and the SP value of the recording medium is set as SP(m), an absolute value of a difference between SP(t) and SP(c) is from 1.5 to 7.0 and the following relational expression (A) is satisfied:

$$|SP(c)-SP(m)|>|SP(t)-SP(m)|. \quad \text{Relational expression (A)}$$

9 Claims, 4 Drawing Sheets

IMAGE FORMING APPARATUS USING A DEVELOPER WITH A SOLUBILITY PARAMETER

CROSS-REFERENCE TO RELATED APPLICATIONS

This application is based on and claims priority under 35 USC 119 from Japanese Patent Application No. 2013-213894 filed Oct. 11, 2013.

BACKGROUND

1. Technical Field

The present invention relates to an image forming apparatus and an image forming method.

2. Related Art

In the related art, an electrophotographic image forming apparatus and an electrophotographic image forming method using a liquid developer in which a toner is dispersed in a carrier liquid as a developer are known.

SUMMARY

According to an aspect of the invention, there is provided an image forming apparatus, including:

an electrostatic latent image holding member;

a charging device that charges the surface of the electrostatic latent image holding member;

a latent image forming device that forms an electrostatic latent image on the surface of the electrostatic latent image holding member;

a developing device that stores a liquid developer containing a toner and a non-volatile carrier liquid, and develops the electrostatic latent image formed on the surface of the electrostatic latent image holding member by the liquid developer to form a toner image;

a transfer device that transfers the toner image onto a surface of an impermeable recording medium; and a fixing device that heats and presses the toner image transferred to the surface of the recording medium and fixes the toner image to the recording medium, wherein when the SP value of the toner is set as SP(t) the SP value of the non-volatile carrier liquid is set as SP(c) and the SP value of the recording medium is set as SP(m), an absolute value of a difference between SP(t) and SP(c) is from 1.5 to 7.0 and the following relational expression (A) is satisfied:

$$|SP(c)-SP(m)|>|SP(t)-SP(m)|. \qquad \text{Relational expression (A)}$$

BRIEF DESCRIPTION OF THE DRAWINGS

Exemplary embodiments of the present invention will be described in detail based on the following drawings, wherein.

DETAILED DESCRIPTION

Figure 1:
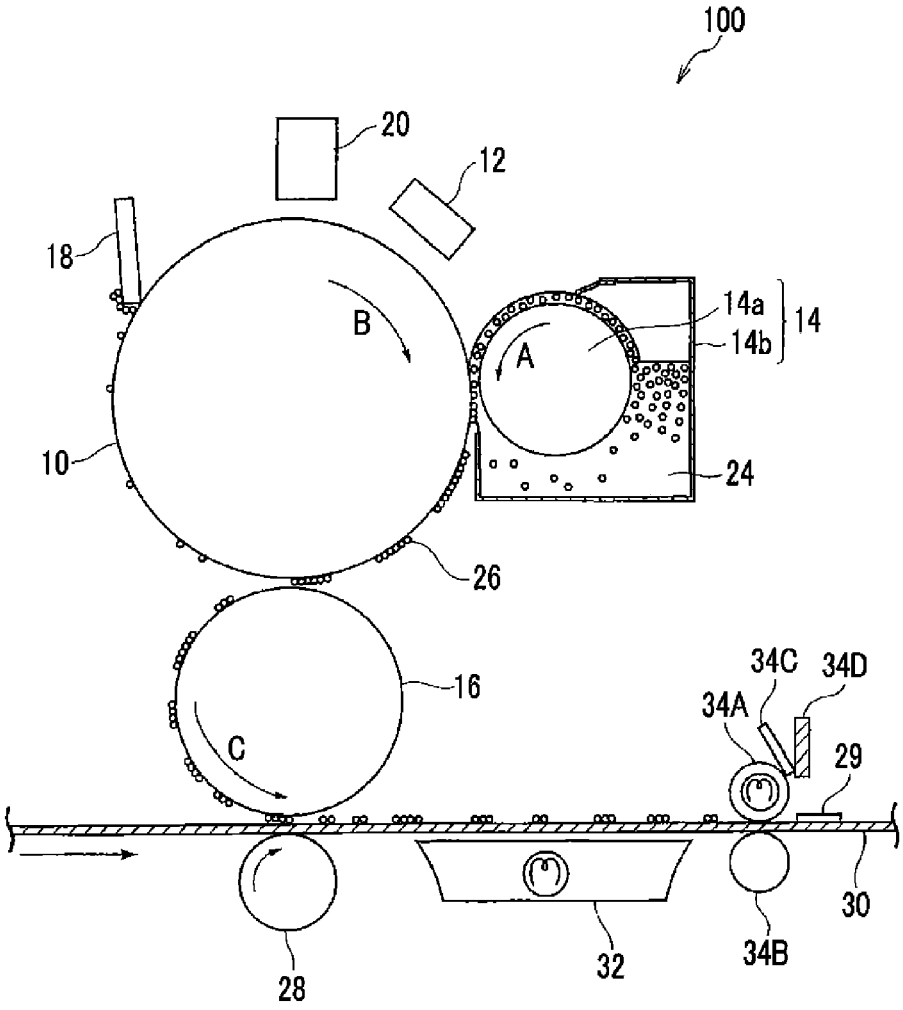
FIG. 1 is a configuration diagram schematically illustrating an example of an image forming apparatus according to the exemplary embodiment.

Hereinafter, exemplary embodiments as examples of the present invention will be described.

An image forming apparatus according to the exemplary embodiment includes an electrostatic latent image holding member; a charging device that charges the surface of the electrostatic latent image holding member; a latent image forming device that forms an electrostatic latent image on the surface of the electrostatic latent image holding member; a developing device that stores a liquid developer containing a toner and a non-volatile carrier liquid, and develops the electrostatic latent image formed on the surface of the electrostatic latent image holding member by the liquid developer to form a toner image; a transfer device that transfers the toner image onto a surface of an impermeable recording medium; and a fixing device that heats and presses the toner image transferred on the surface of the recording medium to fix the toner image to the recording medium.

In the image forming apparatus according to the exemplary embodiment, an image forming method to be performed includes a charging process of charging a surface of an electrostatic latent image holding member; a latent image forming process of forming an electrostatic latent image on the surface of the electrostatic latent image holding member; a developing process of developing the electrostatic latent image formed on the surface of the electrostatic latent image holding member by a liquid developer containing a toner and a non-volatile carrier liquid (hereinafter, simply referred to as a "carrier liquid") to form a toner image; a transferring process of transferring the toner image on a surface of an impermeable recording medium (hereinafter, simply referred to as a "recording medium"); and a fixing process of fixing the toner to the recording medium by heating and pressing the toner image transferred to the surface of the recording medium.

Further, in the image forming apparatus (image forming method) according to the exemplary embodiment, when the SP value of the toner is set as SP(t), the SP value of the non-volatile carrier liquid is set as SP(c), and the SP value of the recording medium is set as SP(m), an absolute value ($\Delta SP(tc)$) of a difference between SP(t) and SP(c) is from 1.5 to 7.0 and the following relational expression (A) is satisfied.

$$|SP(c)-SP(m)|>|SP(t)-SP(m)| \qquad \text{Relational expression (A)}$$

Here, as the carrier liquid of the liquid developer to be used, a non-volatile carrier liquid (oil) is known in terms of reducing the environmental burden and a burden of maintenance management. However, when a toner image developed by a liquid developer containing a non-volatile carrier liquid is transferred to an impermeable recording medium, the carrier liquid is not permeated into the recording medium and an excessive amount of the carrier liquid remains on the surface of the recording medium. Accordingly, in a state in which the remaining carrier liquid is interposed between toners and between the toner and the recording medium, the toner image is fixed to the recording medium, toners are melted, the contact between the toner and the recording medium is suppressed, and the fixation strength of the obtained fixed image is reduced. In the related art, there has been an attempt to remove the carrier liquid using a removing roller before the toner image is fixed, but sufficient fixation strength has not been acquired.

In contrast, in the image forming apparatus (image forming method) according to the exemplary embodiment, a fixed image with excellent fixation strength with respect to the impermeable recording medium is formed by the above-described configuration (technique). The reason for this is not clear, but the following reasons may be considered.

Firstly, the absolute value ($\Delta SP(tc)=|SP(t)-SP(c)|$) of the difference between SP values of the carrier liquid and the toner is set to from 1.5 to 7.0, and appropriate affinity between the carrier liquid and the toner may be acquired. Specifically, when $\Delta SP(tc)$ is set to 1.5 or greater, it is assumed that excessive affinity between the carrier liquid and the toner is suppressed, the carrier liquid is separated from toners in the toner image at the time when the toner image is transferred and fixed to the recording medium, and the carrier liquid is easily eliminated. In contrast, when $\Delta SP(tc)$ is set to 7.0 or less, and dispersibility of the toner into the carrier liquid is ensured in the liquid developer.

Meanwhile, the relational expression (A) indicates that the absolute value of the difference between SP values of the carrier liquid and the recording medium ($\Delta SP(cm)=|SP(c)-SP(m)|$) is greater than the absolute value of the difference between SP values of the toner and the recording medium ($\Delta SP(tm)=|SP(t)-SP(m)|$). That is, the relational expression (A) indicates that the affinity between the toner and the recording medium is higher than the affinity between the carrier liquid and the recording medium. When the relational expression (A) is satisfied, it is assumed that the carrier liquid is easily eliminated from between the recording medium and the toner in the toner image when the toner image is transferred and fixed to the recording medium.

In this way, it is assumed that, when the toner image is transferred and fixed to the recording medium, the carrier liquid is difficult to be interposed between the toners and between the toner and the recording medium by setting the absolute value ($\Delta SP(tc)$) of the difference between SP values of the carrier liquid and the toner to be within the above-described range and by satisfying the relational expression (A). In other words, it is assumed that the carrier liquid is eliminated to the outside of the toner image when the toner image is transferred and fixed to the recording medium, and the carrier liquid is prevented from remaining in the fixed image.

Consequently, it is considered that the toners, and the toner and the recording medium are strongly bonded to each other when the toner image is fixed in this state.

As described above, in the image forming apparatus (image forming method) according to the present embodiment, it is assumed that a fixed image with excellent fixation strength with respect to the impermeable recording medium is formed by the above-described configuration (technique).

Moreover, in the image forming apparatus (image forming method) according to the exemplary embodiment, in terms of efficiently eliminating the carrier liquid between the toners in the toner image and between the toner and the recording medium, and increasing the fixation strength of the fixed image, it is desired that fixation in two stages in the fixing device (fixing process) is performed.

Specifically, the fixing device may include a first heating device that heats the toner image in a non-contact manner up to a temperature equal to or higher than the melting temperature of the toner (for example, a temperature equal to or higher than the temperature (A) at which the storage elastic modulus of the toner becomes $1\times10^5$ Pa) and a second heating and pressing device that heats and presses the toner image at a temperature equal to or higher than the melting temperature of the toner (for example, a temperature equal to or higher than the temperature (A)) after the heating performed by the first heating device. In addition, a fixing process including a first heating process that heats the toner image in a non-contact manner up to a temperature equal to or higher than the melting temperature of the toner and a second heating and pressing process that heats and presses the toner image at a temperature equal to or higher than the melting temperature of the toner after the heating performed in the first heating process may be performed by the fixing device.

The toner is softened and melted and steep change of the elastic modulus occurs by heating up to a temperature equal to or higher than the melting temperature of the toner (for example, a temperature equal to or higher than the temperature (A) at which the storage elastic modulus of the toner becomes $1\times10^5$ Pa) with the first heating device (first heating process). Subsequently, the second heating and pressing device (second heating and pressing process) heats and presses the toner whose elastic modulus is decreased, and then a fixed image is formed. It is assumed that the toner is prevented from remaining unmelted when the fixation is performed by the second heating and pressing device (second heating and pressing process) and the carrier liquid is prevented from remaining in the fixed image because the gap between toners is reduced by allowing the steep change of the elastic modulus to occur by the first heating device (first heating process) in advance.

In a viewpoint of ensuring fluidity of the toner, it is desired that the first heating device (first heating process) perform heating from the side on which the toner image of the recording medium is formed by the heating device that performs heating in a non-contact manner, that is, heating without contact, or perform heating from the back side of the recording medium (the side on which the toner image is not formed), or the combination of the both.

It is desired that the second heating and pressing device include a heating and pressing roll that heats and presses the toner image (a heating and pressing roll that heats and presses the toner image by coming into contact with the toner image), and a carrier liquid removing member that removes the non-volatile carrier liquid attached to the heating and pressing roll. In addition, the second heating and pressing process may preferably be performed by the second heating and pressing device.

In the second heating and pressing device (second heating and pressing process), the carrier liquid is prevented from being attached to the toner image again, by the carrier liquid removing member removing the non-volatile carrier liquid, attached to the heating and pressing roll that heats and presses the toner image. Accordingly, the carrier liquid between the toners in the toner image and between the toner and the recording medium may be efficiently eliminated, and the fixation strength of the fixed image becomes easily increased.

SP value

Hereinafter, the relationship between the liquid developer (the toner and the non-volatile carrier liquid), the impermeable recording medium, and the SP value will be described in detail.

Satisfying the relational expression (A): $|SP(c)-SP(m)|>|SP(t)-SP(m)|$ is equivalent to satisfying any one of the following relational expressions (1) to (4).

$$SP(c)<SP(t)<SP(m) \quad \text{Relational expression (1)}$$

$$SP(c)>SP(t)>SP(m) \quad \text{Relational expression (2)}$$

$$SP(c)>SP(m)>SP(t) \quad \text{Relational expression (3)}$$

[provided that |SP(c)−SP(m)|>|SP(t)−SP(m)|]

$$SP(c)<SP(m)<SP(t) \quad \text{Relational expression (4)}$$

[provided that |SP(c)−SP(m)|>|SP(t)−SP(m)|]

In regard to the relationship between SP values of the liquid developer (the toner and the non-volatile carrier liquid) and the impermeable recording medium, the absolute value of the difference between the following SP values may preferably be satisfied after the relational expression (A), that is, any one of the relational expressions (1) to (4) is satisfied.

The absolute value of the difference between SP values of the carrier liquid and the toner (ΔSP(tc)=|SP(t)−SP(c)|) is from 1.5 to 7.0, preferably from 1.5 to 6.0, and more preferably from 1.7 to 5.7.

When ΔSP(tc) is less than 1.5, the carrier liquid in the fixed image remains, so the fixation strength is weakened. Further, when ΔSP(tc) is more than 7.0, the dispersibility of the toner into the carrier liquid is degraded.

The absolute value (ΔSP(tm)=|SP(t)−SP(m)|) of the difference between SP values of the toner and the recording medium is less than the absolute value (ΔSP(cm)=|SP(C)−SP(m)|) of the difference between SP values of the carrier liquid and the recording medium, and specifically, for example, the absolute value (ΔSP(tm)=|SP(t)−SP(m)|) thereof is preferably 1.0 or less and more preferably 0.5 or less.

In a case where ΔSP(tm) is set to be within the above-described range, the carrier liquid is easily eliminated from between the recording medium and the toner in the toner image when the toner image is transferred and fixed to the recording medium, adhesion between the fixed image and the recording medium becomes strong, and the fixation strength becomes easily increased.

The absolute value (ΔSP(cm)=|SP(c)−SP(m)|) of the difference between SP values of the carrier liquid and the recording medium is greater than the absolute value (ΔSP(tm)) of the difference between SP values of the toner and the recording medium, and specifically, for example, the absolute value (ΔSP(cm)=|SP(c)−SP(m)|) is preferably 1.0 or greater and more preferably 1.5 or greater.

In a case where ΔSP(cm) is set to be within the above-described range, the carrier liquid is easily eliminated from between the toners in the toner image when the toner image is transferred and fixed to the recording medium, bonding strength between the toners becomes strong, and the fixation strength becomes easily increased.

Here, a method of calculating the SP (Solubility Parameter) value will be described. The SP value is the square root of the density of cohesive energy. The SP value of the toner, the SP value of the carrier liquid, and the SP value of the recording medium are calculated by the following method.

The SP value may be calculated by an estimation method of Van Kreveren and Hoftyzer. This method believes that the density of the cohesive energy depends on the type and the number of substituents, and calculates the SP value of a polymer with a segment unit based on the value of the cohesive energy determined for each substituent. Most of the values of the cohesive energy calculated by the method are within the range of the experimental values, and the practicality of the values is high. The SP value is a value obtained by dividing the cohesive energy with molar volume of a substance and acquiring the square root thereof (reference literature: Basis and Application of SP value and Calculation Method, written by Hideki Yamamoto, Johokiko Co., Ltd, published in 2005).

The SP value is calculated such that the unit thereof becomes $cal^{1/2}/cm^{3/2}$ by custom, and is noted as dimensionless. In addition to this, in the present specification, since the relative difference of SP values between two compounds has significance, the values acquired by following the above-described custom is used and the SP value is written as dimensionless in the present specification.

As a reference, in a case where the SP value is converted to an SI unit ($J^{1/2}/m^{3/2}$), the SP value may be multiplied by 2046.

Further, the SP value of the toner is calculated as the SP value of a binder resin exposed to the surface of the toner (surface of a toner particle). In addition, in a case where plural kinds of respective materials are used together, the SP value thereof is calculated as an arithmetic mean whose coefficient is the ratio of the exposed area.

Liquid Developer

The liquid developer contains a toner and a non-volatile carrier liquid. The liquid developer may contain other additives as needed.

Toner

The toner contains a binder resin. The toner may contain a release agent, a colorant, and other additive components.

Binder Resin

The binder resin is not particularly limited, but a resin that is synthesized by a polyaddition reaction or a polycondensation reaction is desired in terms of low temperature fixability and storage stability. Specific examples thereof may include a polyester resin, a polyurethane resin, an epoxy resin, and a polyol resin. Among these, a polyester resin is desired to be used from a viewpoint of compatibility with a crystalline resin used in combination and containability of a release agent.

As described above, in the exemplary embodiment, it is desired to use a crystalline resin in addition to a non-crystalline resin as a binder resin from a viewpoint of obtaining a sharp melting characteristic at the time of fixation.

In addition, the "crystalline resin" in the exemplary embodiment means a resin having a specific endothermic peak, not stepwise change in endothermic amounts, in a differential scanning calorimeter measurement (DSC), and at least means a crystalline resin whose weight average molecular weight exceeds 5,000, and generally means a crystalline resin whose weight average molecular weight is 10,000 or greater.

The crystalline resin will be described.

The crystalline resin is large in decrease of viscosity at a particular temperature because the crystalline resin has a melting temperature, and may have more excellent low temperature fixability because the difference between temperatures from the start of thermal action of a crystalline resin molecule to an area which can ensure the fixation may be decreased when the toner is heated at the time of fixation. The content of the crystalline resin in a toner particle is preferably from 1% by weight to 10% by weight and more preferably from 2% by weight to 8% by weight.

It is appropriate that the crystalline resin has the melting temperature in the range of 45° C. to 110° C. for ensuring the low temperature fixability and the storage stability of the toner. The melting temperature is more preferably in the range of 50° C. to 100° C. and still more preferably in the range of 55° C. to 90° C. The melting temperature of the resin is acquired by a method in conformity with ASTMD3418-8.

The number average molecular weight (Mn) of the crystalline resin is preferably 2,000 or more and more preferably 4,000 or more.

As the crystalline resin, a resin whose weight average molecular weight exceeds 5,000 and has crystallinity is desired, and specific examples thereof may include a crystalline polyester resin and a crystalline vinyl resin, and between these, a crystalline polyester resin is preferable. Further, an aliphatic crystalline polyester resin with an appropriate melting temperature is more preferable.

Examples of the crystalline vinyl resin may include a vinyl resin using (meth)acrylic acid ester of long-chain alkyl or alkenyl such as amyl(meth)acrylate, hexyl(meth)acrylate, heptyl(meth)acrylate, octyl(meth)acrylate, nonyl(meth) acrylate, decyl(meth)acrylate, undecyl(meth)acrylate, tridecyl(meth)acrylate, myristyl(meth)acrylate, cetyl(meth)acrylate, stearyl(meth)acrylate, oleyl(meth)acrylate, or behenyl (meth)acrylate. Further, in the present specification, the meaning of the term "(meth)acryl" includes both of "acryl" and "methacryl"

The crystalline polyester resin is a resin synthesized from a carboxylic acid (dicarboxylic acid) component and an alcohol (diol) component. Hereinafter, the carboxylic acid component and the alcohol component will be described in more detail. In addition, in the present specification, a copolymer that is obtained by copolymerization of another component at a ratio of 50% by weight or less with respect to the main chain of the crystalline polyester resin is also considered as a crystalline polyester resin.

As the carboxylic acid component, aliphatic dicarboxylic acid is preferable and linear carboxylic acid is particularly preferable. Examples thereof may include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, a lower alkyl ester of these dicarboxylic acids, and an acid anhydride of these dicarboxylic acids, but the carboxylic acid component is not limited thereto.

It is desired that the carboxylic acid components include constituent components such as a dicarboxylic acid component having double bonds and a dicarboxylic acid component having a sulfonic acid group in addition to the aliphatic dicarboxylic acid component. In addition, the dicarboxylic acid component having double bonds includes an acid anhydride or a lower alkyl ester of dicarboxylic acid having double bonds in addition to dicarboxylic acid having double bonds. Further, the dicarboxylic acid component having a sulfonic acid group includes an acid anhydride or a lower alkyl ester of dicarboxylic acid having a sulfonic acid group in addition to dicarboxylic acid having a sulfonic acid group.

The dicarboxylic acid having double bonds is capable of crosslinking the entire resin using the double bonds, so dicarboxylic acid is preferably used. Examples of such dicarboxylic acid may include fumaric acid, maleic acid, 3-hexenedioic acid, and 3-octenedioic acid, but are not limited thereto. In addition, lower alkyl esters and acid anhydrides of these are included. Among these, fumaric acid and maleic acid are preferable in terms of cost.

The dicarboxylic acid having a sulfonic acid group is effective in terms that a coloring material such as a pigment may be dispersed in an excellent manner. Further, the dicarboxylic acid may be emulsified or suspended without using a surfactant when a sulfonic acid group is present at the time of preparing particles by emulsifying or suspending the entire resin in water as described below. Examples of the dicarboxylic acid having such a sulfonic acid group may include 2-sulfoterephthalic acid sodium salt, 5-sulfoisophthalic acid sodium salt, and sulfosuccinic acid sodium salt, but are not limited thereto. Further, lower alkyl esters and acid anhydrides of these are included. Among these, 5-sufoisophthalic acid sodium salt is preferable in terms of cost.

The content of the carboxylic acid component (a dicarboxylic acid component having double bonds or a dicarboxylic acid component having a sulfonic acid group) other than these aliphatic dicarboxylic acid components in the carboxylic acid component is preferably from 1% by constituent mole to 20% by constituent mole and more preferably from 2% by constituent mole to 10% by constituent mole.

Further, the term "% by constituent mole" in the exemplary embodiment indicates percentage at the time when each constituent component (a carboxylic acid component and an alcohol component) in a polyester resin is set as a unit (mole).

In contrast, as the alcohol component, aliphatic diol is preferable, and examples thereof may include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, but are not limited thereto.

The content of an aliphatic diol component in the alcohol component is preferably 80% by constituent mole or more, and the alcohol component may include other components. As the alcohol component, the content of the aliphatic diol component is more preferably 90% by constituent mole or more.

Examples of other alcohol components may include a diol component having double bonds and a diol component having a sulfonic acid group.

Examples of the dial component having double bonds may include 2-butene-1,4-diol, 3-butene-1,6-diol, and 4-butene-1,8-diol. On the other hand, examples of the diol component having a sulfonic acid group may include 1,4-dihydroxy-2-sulfonic acid benzene, sodium salt, 1,3-dihydroxymethyl-5-sulfonic acid benzene sodium salt, and 2-sulfo-1,4-butanediol sodium salt.

The content in the alcohol component in a case of adding an alcohol component other than these linear aliphatic diol components (a diol component having double bonds and a diol component having a sulfonic acid group) is preferably from 1% by constituent mole to 20% by constituent mole and more preferably from 2% by constituent mole to 10% by constituent mole.

A method of producing crystalline polyester resin is not particularly limited, the crystalline polyester resin is produced by a general polyester polymerization method of reacting a carboxylic acid component with an alcohol component, and examples thereof may include a direct polycondensation method and a transesterification method, and the methods for producing a crystalline polyester resin are used properly depending on the kind of a monomer. Since the molar ratio (acid component/alcohol component) at the time of reacting the alcohol component with the acid component is different depending on the conditions of the reaction, it cannot be definite, but the molar ratio is generally 1/1.

The crystalline polyester resin is produced at a polymerization temperature of 180° C. to 230° C., and is reacted while removing alcohol or water generated at the time of condensation. In addition, the pressure of the inside of the reaction system may be reduced. In a case in which a monomer is not dissolved or compatible at the reaction temperature, a solvent having a high boiling point may be added and dissolved as a solubilizing agent. The polycondensation reaction is performed while a solubilizing agent is distilled away. In a case in which a monomer with poor compatibility is present in a copolymerization reaction, the monomer with poor compatibility and a carboxylic acid component or an alcohol component to be polycondensed with the monomer are condensed and then may be polycondensed with the main components.

Examples of a catalyst which may be used at the time of producing the crystalline polyester resin may include an alkali metal compound such as sodium or lithium; an alkali earth metal compound such as magnesium or calcium; a metal compound such as zinc, manganese, antimony, titanium, tin, zirconium, or germanium; and a phosphorous acid compound, a phosphoric acid compound, and an amine compound, and specifically, the following compounds are exemplified.

Examples of the catalyst may include compounds such as sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenylphosphonium bromide, triethylamine, and triphenyl amine.

A compound including an alkyl group, an alkenyl group, or an aromatic ring with a shorter chain may be used in addition to the above-described polymerizable monomer for a purpose of adjusting the melting temperature and the molecular weight of the crystalline resin.

Specific examples thereof, in a case of dicarboxylic acid, may include alkyl dicarboxylic acids such as succinic acid, malonic acid, and oxalic acid; aromatic dicarboxylic acids such as phthalic acid, isophthalic acid, terephthalic acid, homophthalic acid, 4,4'-bibenzoic acid, 2,6-naphthalenedicarboxylic acid, and 1,4-naphthalenedicarboxylic acid; nitrogen-containing aromatic dicarboxylic acids such as dipicolinic acid, dinicotinic acid, quinolinic acid, and 2,3-pyrazine dicarboxylic acid; and examples, in a case of diols, may include diols with a short chain alkyl such as succinic acid, malonic acid, acetone dicarboxylic acid, and diglycolic acid; and examples, in the case of a vinyl-based polymerizable monomer with a short chain alkyl, may include (meth)acrylic acid esters of short chain alkyl or alkenyl such as; methyl(meth)acrylate ethyl(meth)acrylate, propyl(meth) acrylate, and butyl(meth)acrylate; vinyl nitriles such as acrylonitrile and methacrylonitrile; vinyl ethers such as vinyl methyl ether and vinyl isobutyl ether; vinyl methyl ketone, vinyl ethyl ketone and vinyl isopropenyl ketone; and olefins such as ethylene, propylene, butadiene, and isoprene. These polymerizable monomers may be used alone or in a combination of two or more kinds thereof.

An amorphous resin will be described.

As the amorphous resin, a known amorphous binder resin for a toner is used, and, for example, a styrene acrylic resin may be used, but an amorphous polyester resin is preferably used.

The glass transition temperature (Tg) of the amorphous polyester resin is preferably in the range of 50° C. to 80° C. and more preferably in the range of 55° C. to 65° C. In addition, the weight average molecular weight is preferably in the range of 8,000 to 30,000 and more preferably in the range of 8,000 to 16,000. Further, a third component may be copolymerized.

Furthermore, it is preferable in terms of improving miscibility that the amorphous polyester resin include an alcohol component or a carboxylic acid component which is common to the crystalline polyester compound used in combination with the amorphous polyester resin.

A method of producing the amorphous polyester resin is not particularly limited, and the amorphous polyester resin may be produced using a general polyester polymerization method as described above.

As a carboxylic acid component used to synthesize the amorphous polyester resin, various dicarboxylic acids described above related to the crystalline polyester resin are used. As an alcohol component, various diols used to synthesize the amorphous polyester resin are used, but bisphenol A, a bisphenol A ethylene oxide adduct, a bisphenol A propylene oxide adduct, hydrogenated bisphenol A, bisphenol S, bisphenol S ethylene oxide adduct, or a bisphenol S propylene oxide adduct may be used in addition to the aliphatic diol described related to the crystalline polyester resin.

In addition, it is particularly preferable to use bisphenol S derivatives such as bisphenol S, a bisphenol S ethylene oxide adduct, and a bisphenol S propylene oxide adduct from a viewpoint of manufacturability, heat resistance, and transparency of a toner. Further, the carboxylic acid component and the alcohol component may contain plural components, and particularly, bisphenol S has an effect of increasing heat resistance.

A crosslinking treatment of a crystalline resin and an amorphous resin used as a binder resin, and a copolymer component which may be used at the time of synthesizing a binder resin will be described.

When a binder resin is synthesized, other components may be copolymerized or a composition containing a hydrophilic polar group may be used.

Specific examples thereof, in a case in which the binder resin is a polyester resin, may include a dicarboxylic acid compound, in which an aromatic ring is directly substituted with a sulfonyl group, such as sulfonyl-terephthalic acid sodium salt or 3-sulfonyl isophthalic acid sodium salt. Further, in a case in which the binder resin is a vinyl resin, examples thereof may include unsaturated aliphatic carboxylic acids such as (meth)acrylic acid and itaconic acid; esters of alcohols and (meth)acrylic acid such as glycerin mono (meth)acrylate, fatty acid-modified glycidyl(meth)acrylate, zinc mono(meth)acrylate, zinc di(meth)acrylate, 2-hydroxyethyl(meth)acrylate, polyethylene glycol(meth)acrylate, or polypropylene glycol(meth)acrylate; a derivative of styrene having a sulfonyl group at any of ortho, meta, or para positions; and sulfonyl group-substituted aromatic vinyl such as sulfonyl group-containing vinyl naphthalene.

A crosslinking agent may be added to the binder resin. Specific examples of the crosslinking agent may include aromatic multi-vinyl compounds such as divinyl benzene and divinyl naphthalene; multi-vinyl esters of aromatic polycarboxylic acid such as divinyl phthalate, divinyl isophthalate, divinyl terephthalate, divinyl homophthalate, divinyl trimesic acid/trivinyl, divinyl naphthalene dicarboxylate, or divinyl biphenyl carboxylate; divinyl esters of nitrogen-containing aromatic compounds such as divinyl pyridine dicarboxylate; unsaturated heterocylic compounds such as pyrrole and thiophene; vinyl esters of unsaturated heterocyclic compound carboxylic acid such as vinyl pyromucate, vinyl furancarboxylate, vinyl pyrrole-2 carboxylate, and vinyl thiophene carboxylate; (meth)acrylic acid esters of linear polyol such as butanediol methacrylate, hexanediol acrylate, octanediol methacrylate, decaendiol acrylate, or dodecanediol methacrylate; (meth)acrylic acid esters of branched, substituted polyol such as neopentyl glycol dimethacrylate, 2-hydroxy, or 1,3-diacryloxypropane; polyethylene glycol di(meth)acrylate or polypropylene polyethylene glycol di(meth)acrylates; or multi-vinyl esters of polycarboxylic acid such as divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, or divinyl brassylate.

Particularly, in the crystalline polyester resin, a method of copolymerizing unsaturated polycarboxylic acids such as fumalic acid, maleic acid, itaconic acid, and trans-aconitic acid in polyester, and crosslinking using multiply bonded parts in the resin or other vinyl-based compounds may be used. In the exemplary embodiment, these crosslinking agents may be used alone or in combination of two or more kinds thereof.

As the method of crosslinking using these crosslinking agents, a method of crosslinking through polymerization together with a crosslinking agent at the time of polymerization of a polymerizable monomer (monomer) or a method of allowing the unsaturated part to remain in a binder resin, and polymerizing the binder resin, or preparing a toner, and crosslinking the unsaturated part by a crosslinking reaction may be used.

In a case in which the binder resin is a polyester resin, the polymerizable monomer may be polymerized by polycondensation. As a catalyst for polycondensation, a known catalyst is used, and specific examples thereof may include titanium tetrabutoxide, dibutyl tin oxide, germanium dioxide, antimony trioxide, tin acetate, zinc acetate, and tin disulfide. In a case in which the binder resin is a vinyl resin, the polymerizable monomer may be polymerized by a radical polymerization.

An initiator for radical polymerization is not particularly limited as long as the initiator can be subjected to emulsion polymerization. Specific examples thereof may include peroxides such as hydrogen peroxide, acetyl peroxide, cumyl peroxide, tert-butyl perxodie, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, peroxycarbonate diisopropyl tetralin hydroperoxide, 1-phenyl-2-methylpropyl-1-hydroperoxide, pertriphenyl acetate-tert-butylhydroperoxide, performic acid tert-butyl, peracetic acid tert-butyl, perbenzoic acid tert-butyl, perphenyl acetate tert-butyl, permethoxy acetate tert-butyl, and N-(3-toluic)percarbamic acid tert-butyl; an azo compound such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane) nitrate, 2,2'-azobisisobutane, 2,2'-azobisisobutyl amide, 2,2'-azobisisobutyronitrile, 2,2'-azobis-2-methyl propionate methyl, 2,2'-dichloro-2,2'-azobisbutane, 2,2'-azobis-2-methylbutyronitrile, 2,2'-dimethyl azobisisobutylate, 1,1'-azobis (sodium 1-methylbutyronitrile-3-sulfonate), 2-(4-methylphenylazo)-2-methylmalonodinitrile, 4,4'-azobis-4-cyano valerate, 3,5-dihydroxymethylphenylazo-2-methylmalonodinitrile, 2-(4-bromophenylazo)2-allylmalonodinitrile, 2,2'-azobis-2-methylvaleronitrile, dimethyl 4,4'-azobis-4-cyanovalerare, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexane carbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), poly(tetraethylene glycol-2,2'-azobisisobutyrate); 1,4-bis(pentaethylene)-2-tetrazene, and 1,4-dimethoxycarbonyl-1,4-diphenyl-2-tetrazene. These polymerization initiators are also used as the initiators at the time of the crosslinking reaction.

Further, as the binder resin, the crystalline polyester resin and the amorphous polyester resin are mainly described above, but other examples thereof may include styrenes such as styrene, parachlorostyrene and α-methylstyrene; acrylic monomers such as methyl acrylate, ethyl acrylate, n-propyl acrylate, butyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylenic unsaturated acid monomers such as acrylic acid, methacrylic acid, and sodium styrene sulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of olefin monomers such as ethylene, propylene, and butadiene; and copolymers in which two or more kinds of these monomers are combined, or mixtures thereof, and further, a non-vinyl aggregation-based resin such as an epoxy resin, a polyester resin, a polyurethane resin, a polyamide resin, a cellulose resin, a polyether resin, a mixture thereof with the above-described vinyl resin, and a graft polymer obtained by polymerizing a vinyl monomer in the presence of these.

In addition, in a case in which a toner is prepared by an emulsion polymerization aggregation method as described below, the resin is prepared as a resin particle dispersion. The resin particle dispersion may be easily obtained by the emulsion polymerization method and a polymerization method in non-uniform dispersion systems similar to this. Further, the resin particle dispersion may be obtained by an arbitrary method such as a method of adding a polymer uniformly polymerized in advance by a solution polymerization method or a bulk polymerization method in a solvent, in which the polymer is not dissolved, with a stabilizer and mechanically mixing and dispersing them.

For example, when a vinyl monomer is used, a resin particle dispersion may be prepared by an emulsion polymerization method or a seed polymerization method using an ionic surfactant or preferably a combination of an ionic surfactant and a non-ionic surfactant.

Examples of the surfactant to be used here may include anionic surfactants such as sulfate ester salts, sulfonate salts, phosphate esters, and soaps; cationic surfactants such as amine salts and quaternary ammonium salts; non-ionic surfactants such as polyethylene glycols, alkyl phenol ethylene oxide adduct, alkyl alcohol ethylene oxide adduct, and polyols; and various graft polymers, but are not limited thereto.

In a case in which a resin particle dispersion is prepared by emulsion polymerization, a protective colloid layer is formed on the surface of a particle by adding unsaturated acids, for example, acrylic acid, methacrylic acid, maleic acid, and styrene sulfonic acid as a part of a monomer component, and thereby soap free polymerization may be performed, which is particularly preferable.

The volume average particle size of a resin particle is preferably 1 μm or less and more preferably from 0.01 μm to 1 μm. In addition, the average particle size of the resin particle is measured using a laser diffraction particle size distribution measurement apparatus (LA-700, manufactured by Horiba, Ltd.).

Release Agent

Examples of the release agent may include low molecular weight polyolefins such as polyethylene, polypropylene, and polybutene; silicones, fatty acid amides such as oleic acid amide, erucic acid amide, ricinoleic acid amide, and stearic acid amide; vegetable waxes such as carnauba wax, rice wax, candelilla wax, wood wax, and jojoba oil; animal wax such as beeswax; mineral wax and petroleum wax such as montan wax, ozokerite, ceresin, paraffin wax, micro-crystalline wax, and Fischer-Tropsch wax; and modifications thereof.

Further, in a case in which a toner is prepared using the emulsion polymerization aggregation method, these release agents may be micronized using a homogenizer or a high pressure type disperser which disperses an ionic surfactant and polyelectrolytes such as polyacid and polybase with the release agent in water, heats the dispersion to be equal to or higher than the melting temperature, and can apply a strong shearing force thereto, and the release agent may be used as a release agent dispersion containing release agent particles with an average particle size of 1 μm or less.

These release agent particles may be added in a mixed solvent together with other resin particle components at one time or may be divided and then added in a stepwise manner when a toner is prepared.

The addition amount of these release agents is preferably in the range of 0.5% by weight to 50% by weight, more preferably in the range of 1% by weight to 30% by weight, and still more preferably in the range of 5% by weight to 15% by weight based on the entirety of the toner particles.

The average dispersion diameter of the release agent to be dispersed and contained in a toner is preferably in the range of 0.3 μm to 0.8 μm and more preferably in the range of 0.4 μm to 0.8 μm.

The standard deviation of the dispersion diameter of the release agent is preferably 0.05 or less and more preferably 0.04 or less.

Further, the average dispersion diameter of the release agent to be dispersed and contained in a toner is acquired by analyzing a TEM (transmission electron microscope) picture with an image analyzing apparatus (manufactured by Nireco Corporation, Luzex, image analyzing apparatus), and by calculating the average value of the dispersion diameter (=(long diameter+short diameter)/2) of the release agent in 100 toner particles, and the standard deviation thereof is acquired based on respective dispersion diameters obtained at this time.

The exposure rate of the release agent on the surface of a toner is preferably in the range of 5% by atom to 12% by atom and more preferably in the range of 6% by atom to 11% by atom.

Here, the exposure rate is acquired by XPS measurement (X-ray photoelectron spectroscope). As an XPS measurement apparatus, JPS-9000MX (manufactured by JEOL, Ltd.) is used, and the measurement is performed by setting the accelerating voltage to 10 kV and the emission current to 30 mA using a MgKα-ray as an X-ray source. Here, the amount of the release agent on the surface of a toner is determined by a peak separation method of a C1S spectrum. In the peak separation method, the measured C1S spectrum is separated into each component using curve fitting by a least-squares method. The C1S spectrum obtained by independently measuring a release agent, a binder resin, and a crystalline resin, which are used to prepare a toner, is used for a component spectrum as the basis of separation.

Colorant

Examples of the colorant may include various pigments such as carbon black, chrome yellow, hansa yellow, benzidine yellow, threne yellow, quinoline yellow, permanent orange GTR, pyrazolone orange, Vulcan orange, Watchung red, permanent red, brilliant carmine 3B, brilliant carmine 6B, Du Pont oil red, pyrazolone red, lithol red, rhodamine B lake, lake red C, rose bengal, aniline blue, ultramarine blue, Calco oil blue, methylene blue chloride, phthalocyanine blue, phthalocyanine green, and malachite green oxalate; and various dyes such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole. The colorants may be used alone or in combination of two or more kinds thereof.

Moreover, when a toner is prepared using an emulsion polymerization aggregation method, these colorants are allowed to be dispersed in a solvent and used as a colorant dispersion. The volume average particle size of the colorant particles in this case is preferably 0.8 μm or less and more preferably from 0.05 μm to 0.5 μm.

The existence ratio of coarse particles having a volume average particle size of 0.8 μM or more in the colorant dispersion is preferably less than 10% by number and preferably 0% by number, and the existence ratio of fine particles having an average particle size of 0.05 μm or less in the colorant dispersion is preferably 5% by number or less.

In addition, the volume average particle size of the colorant particles is measured using a laser diffraction particle size distribution measurement apparatus (LA-700, manufactured by Horiba, Ltd.). Further, it is preferable that the addition amount of the colorant be set in the range of 1% by weight to 20% by weight based on the entirety of the toner particles.

As a method of dispersing these colorants into a solvent, any method, such as a rotating shear type homogenizer, a ball mill having media, a sand mill, and a dyno-mill, may be used and the methods are not limited thereto.

Further, as the colorant, a colorant subjected to a surface reforming treatment by rosin or a polymer may be used. The colorant subjected to the surface reforming treatment is favorable in that the colorant is stabilized in a colorant dispersion, and the colorants are not aggregated to each other in an aggregation process or the like when the colorant is mixed with a resin particle dispersion after being dispersed to a required average particle size in the colorant dispersion and an excellent dispersion state may be maintained.

As the polymer used for a surface treatment of the colorant, an acrylonitrile polymer or a methyl methacrylate polymer is exemplified.

As a condition of the surface reforming, a polymerization method of polymerizing a monomer in the presence of a colorant (pigment) or a phase separation method of dispersing a colorant (pigment) in a polymer solution and reducing solubility of the polymer to be precipitated on the surface of the colorant (pigment) may be used.

Other Added Components

In a case in which a toner is used as a magnetic toner, magnetic powder is included, and examples of the magnetic powder may include metals such as ferrite, magnetite, reduced iron, cobalt, nickel, and manganese, alloys, or compounds containing these metals. Further, various charge-controlling agents, which are generally used, such as quaternary ammonium salts, a nigrosine-based compound, and a triphenylmethane-based pigment may be added.

Inorganic particles may be contained in a toner. It is more preferable in terms of durability that inorganic particles having a median particle size of 5 nm to 30 nm and inorganic particle size having a median particle size of 30 nm to 100 nm be contained in the range of 0.5% by weight to 10% by weight with respect to the toner.

Examples of the inorganic particles may include silica, silica treated with a hydrophobizing agent, titanium oxide, alumina, calcium carbonate, magnesium carbonate, tricalcium phosphate, colloidal silica, cation surface-treated colloidal silica, and anion surface-treated colloidal silica. These inorganic particles are subjected to a dispersion treatment in the presence of an ionic surfactant using an ultrasonic disperser in advance, so it is more preferable for colloidal silica which does not need the dispersion treatment to be used.

A known external additive may be added to a toner. Examples of the external additive may include inorganic particles such as silica, alumina, titania, calcium carbonate, magnesium carbonate, and tricalcium phosphate. For example, as a flowability aid or a cleaning aid, inorganic particles such as silica, alumina, titania, and calcium carbonate, and resin particles such as a vinyl resin, polyester, and silicone are used. The method of adding the external additive is not particularly limited, but the external additive may be added on a surface of toner particles by adding a shearing force in a dried state.

Method of Preparing Toner

A toner may be prepared by any of known methods of preparing a toner, but in terms of controlling the element composition on the surface of the above-described toner particle, it is preferable that a toner be prepared by performing, particularly, a so-called wet producing method, that is, a granulation process of granulating colored particles containing a binder resin and a colorant in water, an organic solvent, or a mixed solvent of those and a cleaning and drying process of cleaning and drying colored particles.

Examples of the wet producing method may include a suspension polymerization method of allowing a colorant, a release agent, and other components to be suspended together with a polymerizable monomer which forms a binder resin such as an amorphous resin and polymerizing a polymerizable monomer; a dissolution suspension method of allowing a toner constituent material such as a compound containing the above-described ionic dissociation group, a binder resin, a colorant, or a release agent to be dissolved in an organic solvent and removing the organic solvent after the obtained solution is dispersed in the aqueous solvent in a suspension state; and an emulsion polymerization aggregation method of producing a binder resin component such as an amorphous resin by the emulsion polymerization and allowing the binder resin component to be hetero-aggregated together with a dispersion of, for example, a pigment or a release agent to be coalesced, but the method is not limited thereto. Further, among these, the emulsion polymerization aggregation method is most preferable because particle size controllability of a toner, narrow particle size distribution, shape controllability, narrow shape distribution, and internal dispersion controllability are excellent.

In a case in which the emulsion polymerization aggregation method is used, a toner may be prepared by at least performing an aggregating process of forming aggregated particles in a raw material dispersion obtained by mixing a resin particle dispersion in which a binder resin such as an amorphous resin or a crystalline resin is dispersed, a colorant dispersion in which a colorant is dispersed, and a release agent dispersion in which a release agent is dispersed; and a coalescence process of allowing aggregated particles to be coalisced by heating the raw material dispersion with the aggregated particles formed therein to a temperature equal to or higher than the glass transition temperature of the binder resin (or melting temperature of the crystalline resin). In addition, other dispersions such as an inorganic particle dispersion may be added to the raw material dispersion. Particularly, in a case in which an inorganic particle dispersion in which particle surfaces are hydrophobized is added thereto, the dispersibility of the release agent and the crystalline resin inside of a toner may be controlled by the degree of hydrophobization.

Hereinafter, the method of preparing a toner according to the exemplary embodiment will be described in detail using an emulsion polymerization aggregation method as a specific example.

In a case in which a toner according to the exemplary embodiment is prepared by the emulsion polymerization aggregation method, a toner is prepared by at least performing the aggregating process and the coalescence process, but an adhesion process of forming aggregated particles having a core-shell structure in which resin particles are allowed to be attached to the surface of the aggregated particles (core particles) formed by the aggregating process may be provided.

Aggregating Process

In the aggregating process, aggregated particles are formed in a raw material dispersion formed by mixing a resin particle dispersion in which a binder resin such as an amorphous resin or a crystalline resin is dispersed (in addition, the amorphous resin or the crystalline resin may be prepared as a separate dispersion), a colorant dispersion in which a colorant is dispersed, and a release agent dispersion in which a release agent is dispersed.

Specifically, the raw material dispersion obtained by mixing various dispersions is heated to form aggregated particles by aggregating particles in a raw material dispersion. Further, the heating is performed at a temperature lower than the glass transition temperature of the amorphous resin. The temperature is preferably in the range of temperatures 5° C. to 25° C. lower than the glass transition temperature.

The aggregated particles are formed by while stirring with a rotating shear type homogenizer, adding a coagulant at room temperature (23° C.), and setting pH of the raw material dispersion to be acidic.

As the coagulant to be used in the aggregating process, a surfactant having a reversed polarity with a surfactant which is used as a dispersant to be added to the raw material dispersion, that is, inorganic metal salts, and a divalent or higher valent metal complex are preferably used. Particularly, it is particularly preferable to use a metal complex because the amount of the surfactant to be used is decreased and the charging characteristic is improved.

Examples of the inorganic metal salts may include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Among these, aluminum salts and a polymer thereof are preferable. For obtaining sharper particle size distribution, valence of the inorganic metal salt is preferably divalent rather than monovalent, trivalent rather than divalent, and tetravalent rather than trivalent. In addition, a polymerization type of an inorganic metal salt polymer is more appropriate when the valence is the same.

Particularly, it is preferable that the inorganic particle dispersion prepared from the inorganic metal salts be added and aggregated together in the aggregating process for controlling the existence ratio of the Group IIA element, the Group IIIB element, and the Group IVB element (excluding carbon). This process contributes to formation of a crosslinked structure by effectively acting on the terminal of a molecular chain of a binder resin.

The inorganic particle dispersion is prepared by the above-described method for the colorant dispersion or the like, and the average dispersed particle size of the inorganic particles is preferably in the range of 100 nm to 500 nm.

The inorganic particle dispersion may be added in a stepwise manner or continuously added in the aggregating process. These methods are effective for achieving the uniform existence ratios from the surface of a toner to the inside thereof. It is particularly preferable that the inorganic particle dispersion be added in three stages or more in the case of adding in a stepwise manner or be added at slow speed equal to or less than 0.1 g/min in the case of continuous adding.

Further, the addition amount of the inorganic particle distribution liquid varies depending on the type of metals to be required or the degree of the crosslinked structure formation, but is preferably in the range of 0.5 part by weight to 10 parts by weight and more preferably in the range of 1 part by weight to 5 parts by weight based on 100 parts by weight of the binder resin component.

The adhesion process may be performed after the aggregating process. In the adhesion process, a coating layer is formed by allowing resin particles to be adhered on the surface of aggregated particles formed by the above-described aggregating process. By doing this, a toner having a so-called core-shell structure in which a core layer is provided and coated may be obtained.

The coating layer is formed by further adding a dispersion containing amorphous resin particles to a dispersion with aggregated particles (core particles) formed therein in the aggregating process. In addition, the amorphous resin used in the adhesion process may be the same as or different from the resin used in the aggregating process.

In general, the adhesion process is used in a case of preparing a toner having a core-shell structure which contains a crystalline resin as a binder resin together with a release agent as a main component, and the main purpose thereof is to suppress the release agent or the crystalline resin contained in the core layer from being exposed on the surface of a toner and to compensate for the strength of the toner particles.

Coalescence Process

The coalescence process performed after the aggregating process, or the aggregating process and the adhesion process, allows aggregated particles to be coalesced by stopping the progress of the aggregation by setting pH of a suspension containing aggregated particles formed after these processes to be in an appropriate range, and then heating the suspension.

Further, particularly, the existence ratio of the Group IA element (excluding hydrogen) is controlled to be within a preferable range depending on the range of the target pH values.

The pH is adjusted by adding acid or alkali. The acid is not particularly limited, but an aqueous solution with inorganic acids such as hydrochloric acid, nitric acid, and sulfuric acid in the range of 0.1% to 50% is preferable. The alkali is not particularly limited, but an aqueous solution having hydroxide of alkali metal such as sodium hydroxide or potassium hydroxide in the range of 0.1% to 50% is preferable. At the time of adjusting the pH, when local change in the pH occurs, local destruction of aggregated particles or locally excessive aggregation occurs, and this leads to degradation of the shape distribution. Particularly, as the scale becomes larger, the amount of acids or alkalis becomes larger. In general, since the site to which acids and alkalis are added is only one site, the concentration of acids and alkalis of the adding site becomes higher as the scale becomes larger if they are treated at the same time.

For setting the range of the existence ratio of the Group IA element (excluding hydrogen) to be the target range, the pH thereof is preferably in the range of 6.0 to 8.0 and more preferably in the range of 6.5 to 7.5.

The aggregated particles are heated to be coalesced after the composition is adjusted as described above. Further, the respective elements are reacted with the terminal of the molecular chain of the resin to form a crosslinked structure at the time of the heating.

Further, in the coalescence, the aggregated particles are coalesced by heating at a temperature equal to or higher than the glass transition temperature (or melting temperature of the crystalline resin) of the amorphous resin.

The crosslinking reaction may be performed by other components when the heating is performed at the time of coalescence or after the coalescence is completed. In addition, the crosslinking reaction may be performed together with the coalescence. The above-described crosslinking agent or the polymerization initiator is used at the time of preparing a toner in a case where the crosslinking reaction is performed.

The polymerization initiator may be mixed with the raw material dispersion in advance when the raw material dispersion is prepared or may be incorporated in the aggregated particles in the aggregating process. Further, the polymerization initiator may be introduced in the coalescence process or after the coalescence process. In the case in which the polymerization initiator is introduced in the aggregating process, the adhesion process, and the coalescence process, or after the coalescence process, a liquid in which the polymerization initiator is dissolved or emulsified is added to a dispersion. A known crosslinking agent, chain transfer agent, or polymerization inhibitor may be added to this polymerization initiator for the purpose of controlling the polymerization degree.

Cleaning Process, Drying Process, and the Like

A cleaning process, a solid-liquid separation process, or a drying process may be performed after the coalescence process of the aggregated particles is completed, and desired toner particles are obtained after these processes are done. In consideration of the charging property, it is preferable that displacement washing be performed with ion exchange water in the cleaning process. Further, the solid-liquid separation process is not particularly limited, and vacuum filtration or pressure filtration is preferable in terms of productivity. Furthermore, the drying process is not particularly limited, and freeze-drying, flash jet drying, fluidized drying, or vibrating fluidized drying may be preferably used in terms of productivity. Furthermore, various external additives may be added to the toner particles after drying.

Physical Properties and the Like of Toner

Figure 5:
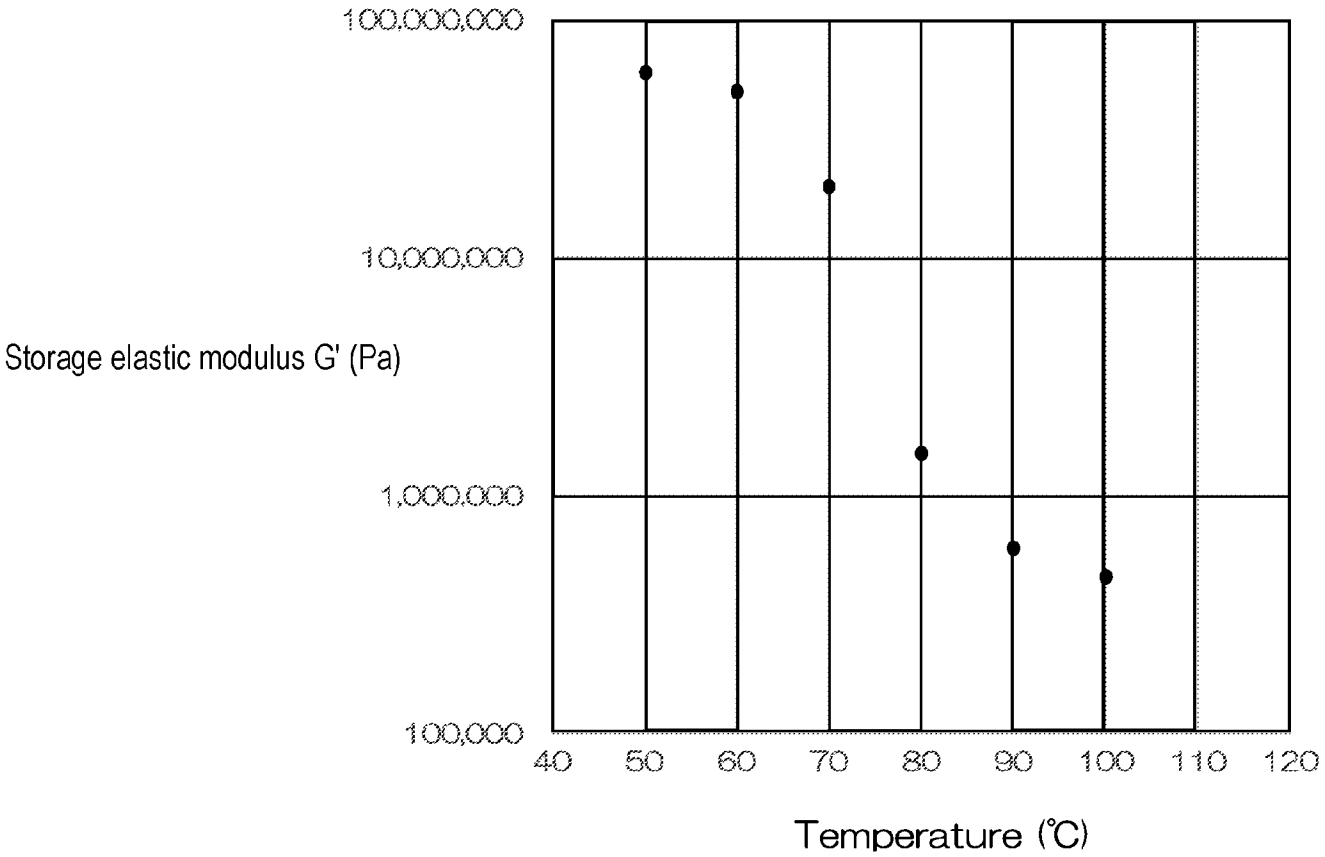
FIG. 5 is a graph that shows the attributes of storage elastic modulus G' with changing temperature according to an exemplary embodiment.

In regard to a toner, a ratio G'(65)/G'(90) of the storage elastic modulus at 65° C. G'(65) to the storage elastic modulus at 90° C. G'(90) is preferably from $1\times10^1$ to $1\times10^3$, as evidenced in FIG. 5. The toner having this storage elastic modulus characteristic has a characteristic in which steep change (specifically, steep change in the elastic modulus in the temperature range of 65° C. to 90° C.) in the storage elastic modulus easily occurs by heating. In the toner with the steep change in the storage elastic modulus, it is assumed that the toner is prevented from remaining unmelted in the melting process at the time of fixation, and the gap between toners is reduced, so the carrier liquid in the fixed image is prevented from remaining. It is considered that the toners become easily and strongly bonded to each other by suppressing the carrier liquid from remaining in the fixed image and it is assumed that the excellent fixability of the toners may be easily obtained. As a result, it is considered that a fixed image with more excellent fixation strength is easily formed with respect to a non-permeable recording medium.

When the ratio G' (65)/G' (90) of the storage elastic modulus is set to $1\times10^1$ or more, viscosity necessary for the fixation becomes easily obtained and the fixing temperature becomes easily decreased. When the ratio G' (65)/G' (90) of the storage elastic modulus is set to $1\times10^3$ or less, hot-offset resistance and fixation strength become easily obtained. Moreover, further preferable range of the ratio G' (65)/G' (90) of the storage elastic modulus is in the range of $1\times10^1$ to $1\times10^2$.

Further, it is preferable that the storage elastic modulus at 65° C. G' (65) of the toner be from $1\times10^6$ Pa to $1\times10^8$ Pa and the storage elastic modulus at 90° C. G' (90) of the toner be from $1\times10^3$ Pa to $1\times10^6$ Pa.

In the case in which the storage elastic modulus at 65° C. G' (65) is set to $1\times10^6$ Pa or greater, heat resistance at the time of storage in a liquid developer cartridge or during the time of being stored in a developing device of an image forming apparatus may be easily obtained. Further, in the case in which the storage elastic modulus at 65° C. G' (65) is set to $1\times10^8$ Pa or less, sufficient fixation strength in the desired fixing temperature may be easily obtained.

On the other hand, in the case in which the storage elastic modulus at 90° C. G' (90) is set to $1\times10^3$ Pa or greater, generation of hot offset at the time of fixation may be easily suppressed. Further, in the case in which the storage elastic modulus at 90° C. G'(90) is set to $1\times10^6$ Pa or less, the carrier liquid in the fixed image is prevented from remaining and excellent fixation strength may be easily obtained.

The storage elastic modulus of a toner may be acquired from dynamic viscoelasticity measured by a sinusoidal oscillation method. The dynamic viscoelasticity is measured using an ARES measurement apparatus (manufactured by Rheometric Scientific Corporation). In the measurement of the dynamic viscoelasticity, the toner is molded to a tablet and is put on a parallel plate having a diameter of 8 mm, and then sinusoidal oscillation is applied thereto at an oscillation frequency of 1 rad/sec after the normal force is set to 0. The measurement is started at a temperature of 20° C. and continued up to a temperature of 100° C. The interval of the measurement time is 30 seconds and the temperature rise is set to 1° C./min.

In addition, the stress dependence of the amount of distortion is checked at intervals of 10° C. from 20° C. to 100° C. before the measurement, and the range of the distortion amount in which the stress and the amount of distortion are in a linear relationship at each temperature is obtained. During the measurement, the amount of distortion at each measurement temperature is maintained in the range of 0.01% to 0.5%, and the stress and the amount of the distortion is controlled to be in a linear relationship at entire measurement temperature ranges, and then the storage elastic modulus is acquired from the measurement results.

Here, the toner having the above-described storage elastic modulus characteristic is not particularly limited, but, for example, may be obtained by allowing the crystalline resin to be contained in the toner and making the temperature change of the storage elastic modulus to be steep. Further, more preferably, when a toner has the below-described composition or is produced by the below-described production method, a toner having the above-described storage elastic modulus characteristic may be more easily obtained.

Moreover, in the toner, it is preferable that the existence ratio of the Group IA element (excluding hydrogen) obtained by XPS (X-ray photoelectron spectroscopy) be in the range of 0.03% by atom to 1.0% by atom and the sum of the existence ratios of the Group IIA element, the Group IIIB element, and the Group IVB element (excluding carbon) be in the range of 0.05% by atom to 2.0% by atom. In this way, a toner having the above-described storage elastic modulus characteristic may be more easily obtained.

Specifically, the existence ratio of the Group IA element (excluding hydrogen) after ion etching obtained by XPS (X-ray photoelectron spectroscopy) is preferably in the range of 0.03% by atom to 1.0% by atom. The existence ratio thereof is more preferably in the range of 0.04% by atom to 0.8% by atom and still more preferably in the range of from 0.1% by atom to 0.6% by atom.

Further, as the Group IA element, it is preferable to contain Na and K.

In addition, the sum of the existence ratios of the Group IIA element, the Group IIIB element, and the Group IVB element (excluding carbon) is preferably in the range of 0.05% by atom to 2.0% by atom. The sum of the existences ratio thereof is more preferably in the range of 0.06% by atom to 1.80% by atom, and still more preferably in the range of 0.1% by atom to 1.5% by atom.

Further, Mg and Ca as the Group IIA element, A1 as the Group IIIB element, and Si as the Group IVB element are preferably contained.

The above-described XPS measurement is performed using an apparatus of JPS9000MX (manufactured by JEOL, Ltd.). Further, the measurement conditions are an accelerating voltage of 10 kV and a current value of 30 mA. The measurement value is a value obtained after performing the ion etching under the conditions of an accelerating voltage of 400 V, a vacuum degree of 1 Pa to $10^{-2}$ Pa, and in Ar atmosphere for 180 seconds (the depth from the surface of toner particles is in the range of 1 nm to 10 nm).

In the toner, the ratio G' (65)/G' (90) of the storage elastic modulus at 65° C. G' (65) to the storage elastic modulus at 90° C. G' (90) at a measurement frequency of 1 (rad/sec) in the dynamic viscoelastic measurement obtained by the sinusoidal oscillation method is in the range of $1\times10^1$ to $1\times10^3$. Further, the value of G' (65)/G' (90) is more preferably in the range of $1\times10^1$ to $1\times10^2$.

The volume average particle size D50v of the toner is preferably in the range of 0.1 μm to 10 μm and more preferably in the range of 1.0 μm to 4 μm.

The volume average particle size distribution index GSDv of the toner is preferably 1.28 or less. On the other hand, the number average particle size distribution index GSDp is preferably 1.30 or less. The volume average particle size distribution index GSDv is more preferably 1.25 or less and the number average particle size distribution index GSDp is more preferably 1.25 or less.

Further, the volume average particle size D50v or various particle size distribution indexes of the toner are measured using Multisizer II (manufactured by Beckman Coulter Inc.) and an electrolyte solution of ISOTON-II (manufactured by Beckman Coulter Inc.). During the measurement, a measurement sample in an amount of 0.5 mg to 50 mg is added to 2 mL of a 5% aqueous solution of a surfactant as a disperser, preferably, sodium alkyl benzene sulfonate, and the resultant is added to 100 mL to 150 mL of the electrolyte solution.

The electrolyte solution with the sample suspended therein is subjected to a dispersion treatment using an ultrasonic disperser for 1 minute, and the particle size distribution of particles having a particle size of 2.0 μm to 60 μm is measured by the Multisizer II type using an aperture having an aperture diameter of 100 μm. In addition, the number of particles to be sampled is 50,000.

By illustrating the cumulative distribution of the volumes and the numbers from the small diameter side with respect to the range of the particle size (channel), which is divided based on the particle size distribution to be measured in this way, the particle size with 16% of cumulation is defined as cumulative volume average particle size D16v and cumulative number average particle size D16p, the particle size with 50% of cumulation is defined as cumulative volume average particle size D50v and cumulative number average particle size D50p, and the particle size with 84% of cumulation is defined as cumulative volume average particle size D84v and cumulative number average particle size D84p.

Using these, the volume average particle size distribution index (GSDv) is calculated by the formula of $(D84v/D16v)^{1/2}$ and the number average particle size distribution index (GSDp) is calculated by the formula of $(D84p/D16p)^{1/2}$.

The average circularity of the toner is preferably in the range of 0.940 to 0.980 and more preferably in the range of 0.950 to 0.970.

Further, the average circularity of the toner is measured by a flow-type particle image analyzer FPIA-2000 (manufactured by Toa Denshi Co., Ltd.). As a specific measurement method, a surfactant as a disperser, preferably 0.1 mL to 0.5 mL of alkyl benzene sulfonate, is added to 100 mL to 150 mL of water from which solid impurities are removed in advance, and a measurement sample is added thereto in a range of 0.1 g to 0.5 g. The suspension in which the measurement sample is dispersed is subjected to a dispersion treatment using an ultrasonic disperser for 1 to 3 minutes, and the average circularity of the toner is measured using the apparatus by setting the range of the dispersion concentration to from 30,000,000/μL to 10,000/μL.

The glass transition temperature Tg of the toner is not particularly limited, but a temperature range of 40° C. to 70° C. is preferably selected.

Further, the glass transition temperature Tg of the toner is measured using a DSC measuring machine (differential scanning calorimeter DSC-7, manufactured by PerkinElmer Co., Ltd.) in conformity with ASTMD3418-8. The melting temperature of indium and zinc is used for temperature correction of a detection unit of the apparatus and the fusion heat of indium is used for correction of the amount of heat. The measurement is performed on a sample by using an aluminum pan and setting an empty pan as a control, with a temperature rising speed of 10° C./min.

Carrier Liquid

As the carrier liquid, a carrier liquid (non-volatile oil) which is non-volatile, has a difference (ΔSP(tc)) between SP values of the carrier liquid and the toner of 1.5 to 7.0, and satisfies the relational expression (A) is used. Accordingly, a carrier liquid in which ΔSP(tc) is within the above-described range and the relational expression (A) is satisfied is selected to be used in accordance with the SP values of the toner and the recording medium.

Here, the non-volatile carrier liquid means a carrier liquid with a flash point of 170° or higher or with a volatile matter content of 8% by weight or less at 150° C. after 24 hours.

The type of the carrier liquid is not particularly limited as long as the requirements of ΔSP(tc) are satisfied, and silicone oil or polyol is exemplified.

Examples of the silicone oil may include dimethyl silicone oil (KF-96, KF-965, KF-968, and the like, as commercially available products, manufactured by Shin-Etsu Chemical Co., Ltd.), methyl hydrogen silicone oil (KF-99 and the like, manufactured by Shin-Etsu Chemical Co., Ltd.), and methyl phenyl silicone oil (KF-50, KF-54, and the like, manufactured by Shin-Etsu Chemical Co., Ltd.).

Examples of the polyol may include ethylene glycol (as commercially available products, manufactured by Wako Pure Chemical Industries, Ltd.), diethylene glycol (as commercially available products, manufactured by Wako Pure Chemical Industries, Ltd.), and propylene glycol (as commercially available products, manufactured by Wako Pure Chemical Industries, Ltd).

As the type of the carrier liquid, in addition to the above, aliphatic hydrocarbon solvents such as paraffin oil (as commercially available products, Moresco white MT-30P, Moresco white P40, and Moresco white P70, manufactured by Matsumura Oil Co., Ltd., and Isopa L, Isopa M, and the like, manufactured by Exxon Chemical Co., Ltd.); hydrocarbon-based solvents such as naphthene oil (as commercially available products, Exxsol D80, Exxsol D110, and Exxsol D130, manufactured by Exxon Chemical Co., Ltd., and Naphtesol L, Naphtesol M, Naphtesol H, NewNaphtesol 160, New Naphtesol 200, New Naphtesol 220, New Naphtesol MS-20P, and the like, manufactured by Nippon Petrochemicals Co., Ltd.); aromatic compounds such as toluene; and cyclohexane, tetrahydrofuran, acetone, and 2-butanol are exemplified.

Among these, silicone oil, and particularly, dimethyl silicone oil are preferable. Particularly, when dimethyl silicone oil as a carrier liquid is combined with a toner having the above-described storage elastic modulus characteristics, a fixed image with excellent fixation strength with respect to a non-permeable recording medium is easily formed.

Moreover, in a case of using a toner containing crystalline polyester, it is effective to combine, particularly, silicone oil as a carrier liquid from a viewpoint of controlling ΔSP(tc) to be in the above-described range.

Further, the flash point of the carrier liquid is preferably 170° C. or higher and more preferably 200° C. or higher.

The above-described flash point is measured according to JIS K2265-4 (in the year 2007).

The carrier liquid may contain various secondary materials such as a dispersant, an emulsifier, a surfactant, a stabilizer, a wetting agent, a thickener, a foaming agent, an anti-foaming agent, a coagulating agent, a gelling agent, an anti-settling agent, a charge-controlling agent, an antistatic agent, an anti-aging agent, a softener, a plasticizer, a filler, a reodorant, an anti-tack agent, and a release agent.

Recording Medium

As the recording medium, a recording medium which is non-permeable, and satisfying the relational expression (A) is used. Accordingly, a recording medium satisfying the relational expression (A) is selected to be used in accordance with the SP values of the toner and the carrier liquid.

Here, what is meant by the non-permeable recording medium is as follows. When a liquid film of 10 g/m$^2$ or less is formed on a recording medium and change in weight of the liquid film on the medium after one hour is 1% or less, the recording medium is a non-permeable recording medium, provided that the volatile content of the liquid film is eliminated from the change in weight.

As the type of the recording medium, various resin sheets are exemplified, and specific examples thereof may include resin sheets of polystyrene, methyl polymethacrylate, polyvinyl chloride, polyethylene terephthalate, 66-nylon, polyethylene, and polypropylene. The resin sheet may be a sheet of plural kinds of mixed resins.

Among these, at least one kind of resin sheet selected from a group consisting of polystyrene, methyl polymethacrylate, polyvinyl chloride, polyethylene terephthalate, and 66-nylon is desired from a viewpoint of satisfying the relational expression (A).

Image Forming Apparatus/Image Forming Method

Hereinafter, an image forming apparatus (image forming method) according to the exemplary embodiment will be described in detail with reference to the drawings.

FIG. 1 is a configuration diagram schematically illustrating an example of the image forming apparatus according to the exemplary embodiment.

An image forming apparatus 100 is configured to include a photoreceptor (an example of an electrostatic latent image holding member) 10, a charging device 20, an exposure apparatus (an example of a latent image forming device) 12, a developing device 14, an intermediate transfer member 16, a cleaner 18, a transfer roller (an example of a transfer device) 28, a non-contact heating device (an example of a first heating device) 32, and heating and pressing rolls (an example of the second heating and pressing device) 34A and 34B.

The photoreceptor 10 has a cylindrical shape. The charging device 20, the exposure apparatus 12, the developing device 14, the intermediate transfer member 16, and the cleaner 18 are provided in the periphery of the photoreceptor 10 in this order. The transfer roller 28 is provided at a position in which a toner image 26 transferred to the intermediate transfer member 16 is transferred to a recording medium 30. Further, the non-contact heating device (first heating device) 32 is provided on the downstream side of the transfer roller 28 in the travelling direction of the recording medium 30, and a pair of the heating and pressing rolls 34A and 34B are further provided on the downstream side of the non-contact heating device 32 in the travelling direction of the recording medium 30. A fixing device is formed of the non-contact heating device 32 and the heating and pressing rolls 34A and 34B.

In the heating and pressing roll 34A, a blade 34C (an example of a carrier liquid removing member) for removing an adhered carrier liquid after the heating and pressing roll 34A comes into contact with the toner image on the recording medium 30 and performing heating and pressing, and a carrier liquid collecting unit 34D for collecting the carrier liquid removed by the blade 34C are provided.

Hereinafter, the operation of the image forming apparatus 100 will be briefly described.

The charging device 20 charges the surface of the photoreceptor 10 to a predetermined potential and the exposure apparatus 12 forms an electrostatic latent image by exposing the charged surface to a laser light beam or the like based on an image signal.

The developing device 14 is configured to include a developing roller 14*a* and a developer container 14*b*. The developing roller 14*a* is provided such that a part thereof is immersed in a liquid developer 24 accommodated in the developer container 14*b*. Toner particles are dispersed in the liquid developer 24, but the liquid developer 24 may be further stirred by a stirring member which is provided in the developer container 14*b*.

The liquid developer 24 supplied to the developing roller 14*a* is transported to the photoreceptor 10 in a state in which the amount of the liquid developer is controlled to be the supply amount determined by a restricting member, and is supplied to the electrostatic latent image at a position in which the developing roller 14*a* and the photoreceptor 10 face each other (or are in contact with each other). By doing this, the electrostatic latent image is visualized to become the toner image 26.

The developed toner image 26 is transported to the photoreceptor 10 rotating in the arrow B direction of the figure and transferred to the recording medium 30, but the toner image is temporarily transferred to the intermediate transfer member 16 before being transferred to the recording medium 30 in the exemplary embodiment. At this time, a circumferential speed difference may be provided between the photoreceptor 10 and the intermediate transfer member 16.

Next, the toner image transported in the arrow C direction by the intermediate transfer member 16 is transferred to the recording medium 30 at a position in contact with the transfer roller 28.

The non-contact heating device 32 is provided on the downstream side of the transfer roller 28 in the travelling direction of the recording medium 30. The non-contact heating device 32 is a plate-like heating device and is provided with a heater in a plate-like member whose surface is formed of metal. The toner image is heated up to a temperature equal to or higher than the melting temperature of the toner (for example, a temperature equal to or higher than the temperature (A) at which storage elastic modulus of the toner becomes $1\times10^5$ Pa) at the position of the non-contact heating device 32.

As the heater used for the heating device 32, for example, a halogen heater or a hot air dryer is used in a case of heating from a toner image which is a target to be heated to the toner image in a non-contact manner, and a heating plate or a heating roll in contact with the back surface of the toner image side is used in a case of heating from the back surface of the toner image (that is, the recording medium side) which is a target to be heated.

Further, the heating temperature of the non-contact heating device 32 is preferably 90° C. or higher and more preferably in the range of 100° C. to 125° C. Moreover, the heating time thereof is determined by the length of the non-contact heating device 32 in the travelling direction of the recording medium 30 and the process speed.

The heating and pressing rolls 34A and 34B are provided on the downstream side of the non-contact heating device 32 in the travelling direction of the recording medium 30. The toner image heated by the non-contact heating device 32 is fixed to the recording medium 30 by being heated and pressed at a temperature equal to or higher than the melting temperature of the toner (for example, a temperature equal to or higher than the temperature (A) at which storage elastic modulus of the toner becomes $1\times10^5$ Pa) by the heating and pressing rolls 34A and 34B.

The heating and pressing rolls 34A and 34B are arranged to face each other so as to form a nip by interposing the recording medium 30 therebetween. The heating and pressing rolls 34A and 34B form an elastic rubber layer on a metal roll and a release layer for releasing a toner and interpose the recording medium 30 by a pressing mechanism (not illustrated) so as to obtain a predetermined pressure and a predetermined width of the nip. Further, a heater is provided in at least one of the heating and pressing rolls 34A and 34B, but the heater may be provided in both of the heating and pressing rolls 34A and 34B.

The heating temperature of the heating and pressing rolls 34A and 34B is preferably in the range of 110° C. to 150° C. and more preferably in the range of 120° C. to 140° C. In addition, the pressure to be applied is preferably in the range of 1.5 kg/cm$^2$ to 5 kg/cm$^2$ and more preferably in the range of 2 kg/cm$^2$ to 3.5 kg/cm$^2$.

The toner image is fixed to the recording medium 30 in a position of the heating and pressing rolls 34A and 34B, and a fixed image 29 is formed, and then the recording medium 30 is transported to a discharging unit (not illustrated).

On the other hand, in the photoreceptor 10 that transfers the toner image 26 to the intermediate transfer member 16, the residual toner is transported to a position in contact with the cleaner 18 cleaning residual toner particles after transfer and collected by the cleaner 18. In addition, in a case in which the transfer efficiency is close to 100% and generation of the residual toner is decreased, the cleaner 18 may not be provided. Further, the carrier liquid attached to the heating and pressing roll 34A is removed by the blade 34C and collected by the carrier liquid collecting unit 34D.

The image forming apparatus 100 may be further provided with an erasing apparatus (not illustrated) which erases the surface of the photoreceptor 10 after the transfer is done and before the next charging is performed.

The charging device 20, the exposure apparatus 12, the developing device 14, the intermediate transfer member 16, the transfer roller 28, the cleaner 18, the non-contact heating device (first heating device) 32, and the heating and pressing rolls (second heating and pressing device) 34A and 34B provided in the image forming apparatus 100 are all operated synchronously with the rotation speed of the photoreceptor 10.

Next, an image forming apparatus of another aspect according to the exemplary embodiment will be described in detail with reference to the drawings.

Figure 2:
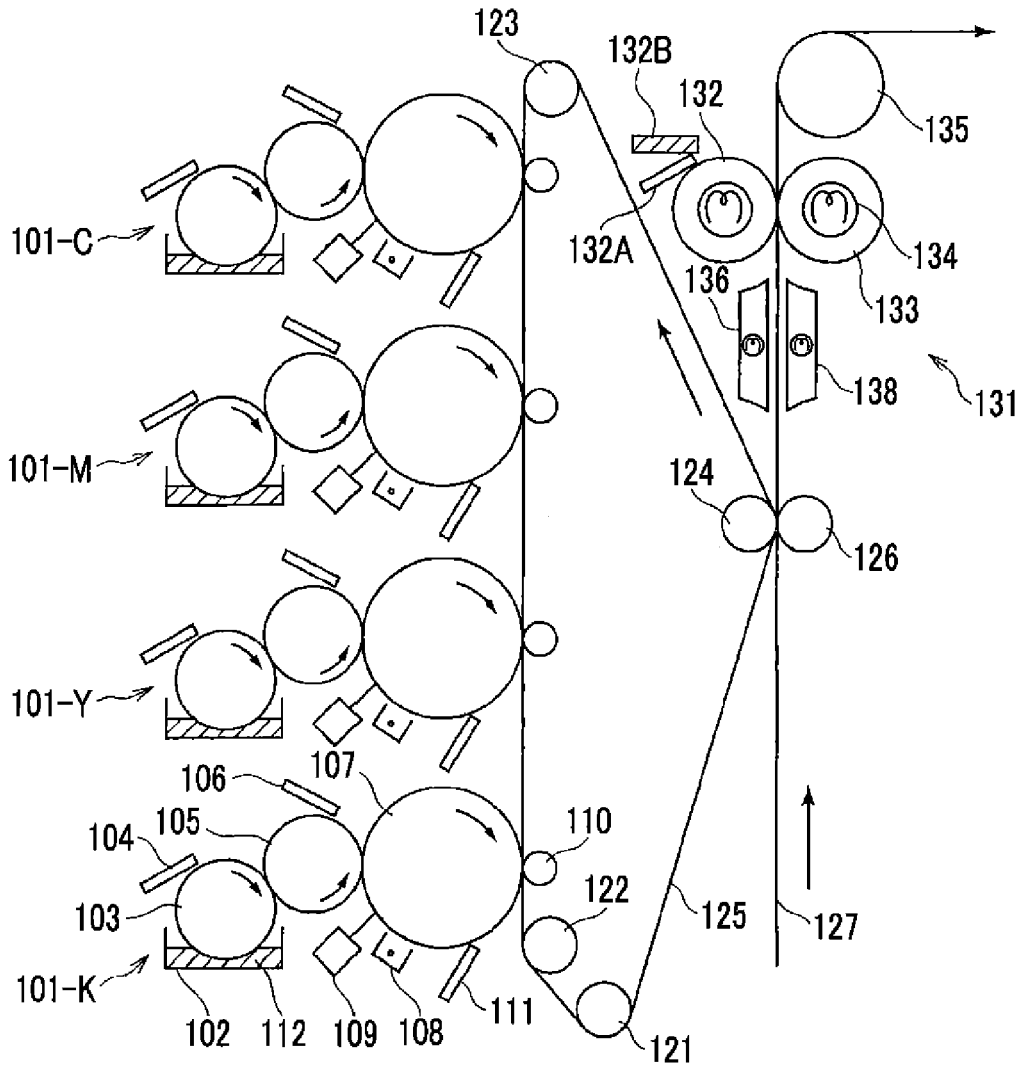
FIG. 2 is a configuration diagram schematically illustrating another example of an image forming apparatus according to the exemplary embodiment.

FIG. 2 is a configuration diagram schematically illustrating an example of another aspect of an image forming apparatus according to the exemplary embodiment, and illustrates a tandem type of image forming apparatus.

The image forming apparatus illustrated in FIG. 2 includes a cyan developing unit 101-C, a magenta developing unit 101-M, a yellow developing unit 101-Y, and a black developing unit 101-K. Respective developing units include a developer tank 102, a developer supplying roll 103, a supply amount restricting unit 104, a developing roll (an example of a developing device) 105, a developing roll cleaner 106, a photoreceptor (an example of an electrostatic latent image holding member) 107, a charging device 108, an exposure apparatus (an example of a latent image forming device) 109, a primary transfer device 110, and a photoreceptor cleaner 111. Further, an intermediate transfer member 125 is provided so as to be in contact with each of the photoreceptors 107 of four respective developing units, and secondary transfer devices 124 and 126 with which the toner image transferred to the intermediate transfer member 125 is transferred to a recording medium 127 are further provided. A fixing unit (an example of a fixing device) 131 is provided on the downstream side of the secondary transfer devices 124 and 126 in the travelling direction of the recording medium 127 and a discharging roll 135 is further provided on the downstream side of the fixing unit 131.

The fixing unit 131 is provided with non-contact heating devices (an example of a first heating device) 136 and 138; a heat roll 132; and a pressure roll 133 (an example of a second heating and pressing device) in this order from the upstream side in the travelling direction of the recording medium 127; The heat roll 132 is provided with a blade 132A (an example of a carrier liquid removing member) for removing the attached carrier liquid after the heat roll 132 comes into contact with a toner image on the recording medium 127 and performing heating and pressing; and a carrier liquid collecting unit 132B that collects the carrier liquid removed by the blade 132A.

The amount of the liquid developer 112, which is determined by a developer circulating unit (not illustrated) is maintained in the developer tank 102 and the liquid developer is transported from the developer tank 102 to the developing roll 105 by the developer supplying roll 103. The developer supplying roll 103 has a system of allowing the developer to be attached with an electrostatic force by charging the surface or a system of transporting a liquid so as to be drawn by providing a groove or a concave on the roll, and the supply amount restricting unit 104 restricts the feeding amount to be a predetermined value. The photoreceptor 107 is charged by the charging device 108 such that the surface has a predetermined charge bias amount and an electrostatic latent image is formed on the surface by the light beams from the exposure apparatus 109 in accordance with the image signal which is sent from a host computer (not illustrated). The liquid developer on the developing roll 105 is transferred to the photoreceptor 107 according to the electrostatic latent image to form a toner image, and an unnecessary developer is returned to the developer tank 102 by the developing roll cleaner 106 and the developer circulating unit (not illustrated).

The toner image formed on the photoreceptor 107 is transferred to the intermediate transfer member 125 by the primary transfer device 110. In addition, the intermediate transfer member 125 is supported by a driving roll 121, supporting rolls 122 and 123, and the secondary transfer device 124, and the driving roll 121 drives the intermediate transfer member 125 in the arrow direction by a driving motor and a power transmission mechanism (both not illustrated), and the tension determined by a spring mechanism (not illustrated) is applied to the intermediate transfer member 125. The primary transfer device 110 transfers cyan, magenta, yellow, and black toner images to the intermediate transfer member 125 in order by the electrostatic force and the pressure. Set potentials may vary in the primary transfer device 110 of each color. The liquid developer remaining on the photoreceptor 107 is removed by a photoreceptor cleaner 111.

The toner image transferred to the intermediate transfer member 125 is transferred to the recording medium 127 by the secondary transfer devices 124 and 126 and is fixed by the fixing unit 131.

The fixing unit 131 includes a first heating device and a second heating and pressing device in this order from the upstream side in the travelling direction of the recording medium 127 and includes a non-contact heating devices 136 and 138 as the first heating device. The non-contact heating devices 136 and 138 are plate-like heating devices and a heater is provided in a plate-like member whose surface is formed of metal. The toner image is heated up to a temperature equal to or higher than the melting temperature of the toner (for example, a temperature equal to or higher than the temperature (A) at which storage elastic modulus of the toner becomes $1\times10^5$ Pa) in the position of the non-contact heating devices 136 and 138.

The heating temperature of the non-contact heating devices 136 and 138 is preferably 90° C. or higher and more preferably in the range of 100° C. to 125° C. Further, the heating time thereof is determined according to the length of the non-contact heating devices 136 and 138 in the travelling direction of the recording medium 30 and the process speed.

In addition, the fixing unit 131 includes a pair of a heat roll 132 and a pressure roll 133, and a heater 134 provided in the respective rolls, as the second heating and pressing device. The toner image heated by the non-contact heating devices 136 and 138 is fixed to the recording medium 127 by being heated and pressed at a temperature equal to or higher than the melting temperature of the toner (for example, a temperature equal to or higher than the temperature (A) at which storage elastic modulus of the toner becomes $1\times10^5$ Pa) by the pair of the heat roll 132 and the pressure roll 133.

The heat roll 132 and the pressure roll 133 are arranged to face each other so as to form a nip by interposing the recording medium 127. Each of the heat roll 132 and the pressure roll 133 forms an elastic rubber layer on a metal roll and a release layer for releasing a toner and interposes the recording medium 127 by a pressing mechanism (not illustrated) so as to obtain a predetermined pressure and a predetermined width of the nip. Further, a heater is provided in both of the heat roll 132 and the pressure roll 133, but the heater may be provided in only either of the heat roll 132 and the pressure roll 133.

The heating temperature of the heat roll 132 and the pressure roll 133 is preferably in the range of 110° C. to 150° C. and more preferably in the range of 120° C. to 140° C. Further, the pressure to be applied is preferably in the range of 1.5 kg/cm$^2$ to 5 kg/cm$^2$ and more preferably in the range of 2 kg/cm$^2$ to 3.5 kg/cm$^2$.

Further, a discharging roll 135 is provided on the downstream side of the fixing unit 131, and the recording medium 127 to which the toner image is fixed is transported to a discharging unit (not illustrated) by the discharging roll 135.

In addition, as the first heating device, a plate-like heating device, which heats from the rear side of the recording medium (the side opposite to the toner image), with a heater provided therein is illustrated in the image forming apparatus shown in FIG. 1 and a system of heating the recording medium from both of the front and rear sides by the plate-like heating device with a heater provided therein in a non-contact manner is described in the image forming apparatus shown in FIG. 2, but the system of the first heating device is not particularly limited as long as the first heating device can heat the front side of the recording medium (toner image side) in a non-contact manner. For example, the plate-like heating device with a heater provided therein may heat the recording medium only from the front side thereof (toner image side). Further, a blowing apparatus that blows hot wind and an irradiation apparatus that radiates infrared light may be applied.

Moreover, as the second heating and pressing device, a pair of the heating and pressing rolls 34A and 34B is illustrated in the image forming apparatus shown in FIG. 1 and a pair of the heat roll 132 and the pressure roll 133 is illustrated in the image forming apparatus shown in FIG. 2, but the second heating and pressing device is not limited thereto. For example, an apparatus combining a heating and pressing roll and a pressure belt or an apparatus combining a pressing roll and a heating and pressing belt may be used.

Further, the system of the image forming apparatus in FIGS. 1 and 2 may be a system of supplying a liquid developer from a liquid developer cartridge (not illustrated), which is detachable from the image forming apparatus, to the developer container 14*b* or the developer tank 102.

Furthermore, the system of the developing device 14 in the image forming apparatus shown in FIG. 1 may be a system of a process cartridge to be detachable from the image forming apparatus 100 or may be a system of a process cartridge to be detachable from the image forming apparatus, formed by integrating the developer tank 102, the developer supplying roll 103, the supply amount restricting unit 104, the developing roll 105, and the developing roll cleaner 106 in the image forming apparatus shown in FIG. 2.

EXAMPLES

Hereinafter, the present invention will be described more specifically with reference to the examples, but is not limited thereto. In addition, hereinafter, "part" and "%" are based on weight unless otherwise noted.

Measurement Method of Various Characteristics

Firstly, a method of measuring physical properties of the toner or the like used in each example will be described.

Molecular Weight of Resin

The molecular weight of a resin is measured under the following conditions. "HLC-8120GPC and SC-8020 apparatuses (manufactured by Tosoh Co., Ltd.)" is used as GPC, two of "TSKgel, SuperHM-H (6.0 mm ID×15 cm, manufactured by Tosoh Co., Ltd.)" are used as a column, and THF (tetrahydrofuran) is used as an eluent. A test is performed using an RI (Refractive Index) detector under the conditions of a sample concentration of 0.5%, a flow rate of 0.6 mL/min, a sample injection amount of 10 μL, and a measurement temperature of 40° C. Further, a calibration curve is produced from 10 samples of "polystyrene standard sample TSK standard (manufactured by Tosoh Co., Ltd.)": "A-500", "F-1", "F-10", "F-80", "F-380", "A-2500", "F-4", "F-40", "F-128", and "F-700."

Volume average particle size of toner, resin particle, colorant particle, or the like The volume average particle size of the toner, a resin particle, a colorant particle, or the like is measured by the following method.

When the particle diameter to be measured is 2 μm or more, coulter multisizer II (manufactured by Beckman Coulter Inc.) is used as a measurement apparatus, and ISOTON-II (manufactured by Beckman Coulter Inc.) is used as an electrolyte solution, and then the particle size is measured.

In the measurement method, a measurement sample in an amount of 0.5 mg to 50 mg is added to 2 mL of a 5% aqueous solution of a surfactant as a disperser, preferably, sodium alkyl benzene sulfonate, and the resultant is added to 100 mL to 150 mL of the electrolyte solution. The electrolyte solution with the measurement sample suspended therein is subjected to a dispersion treatment using an ultrasonic disperser for 1 minute, and the particle size distribution of particles having a particle size of 2.0 μm to 60 μm is measured by the Multisizer II type using an aperture having an aperture diameter of 100 μm. In addition, the number of particles to be measured is 50,000.

By illustrating the cumulative distribution of the volumes and the numbers from the small diameter side with respect to the range of the particle size (channel), which is divided based on the particle size distribution to be measured, the particle size with 16% of cumulation by volume is defined as cumulative volume average particle size D16v and the cumulative number average particle size with 16% of cumulation by number is defined as D16p. Further, the particle size with 50% of cumulation by volume is defined as cumulative volume average particle size D50v and the particle size with 50% of cumulation by number is defined as cumulative number average particle size D50p, and the particle size with 84% of cumulation by volume is defined as cumulative volume average particle size D84v and the cumulative number particle size with 84% of cumulation by number is defined as cumulative number average particle size D84p. The volume average particle size is D50v.

Using these, the volume average particle size distribution index (GSDv) is calculated by $(D84v/D16v)^{1/2}$, the number average particle size index (GSDp) is calculated by $(D84p/D16p)^{1/2}$, and the number average particle size index on the small diameter side (low GSDp) is calculated by (D50p)/(D16p)).

On the other hand, when the particle size to be measured is less than 2 μm, the diameter is measured by a laser diffraction particle size distribution measurement apparatus (LA-700, manufactured by Horiba, Ltd.). In the measurement method, a sample in a state of a dispersion is adjusted to be 2 g by a solid content, and ion exchange water is added thereto to set the amount thereof to be 40 mL. Next, the resultant is added to a cell to make an appropriate concentration, and two minutes pass, and then the measurement is performed when the concentration in the cell is stabilized. The volume average particle sizes for each of the obtained channels are cumulated in the ascending order of the volume average particle sizes, and the point with 50% of cumulation is set to the volume average particle size.

Glass Transition Temperature and Melting Temperature of Resin

The glass transition temperature (Tg) and the melting temperature (Tm) are obtained from respective maximum peaks measured in conformity with ASTMD3418-8. Further, a temperature at the intersection of extended lines of a base line and a rising line in an endothermic portion is set to the glass transition temperature, and a temperature at the top of the endothermic peak is set to the melting temperature. A differential scanning calorimeter (DSC-7, manufactured by PerkinElmer Co., Ltd.) is used for the measurement. In addition, the melting temperatures of indium and zinc are used for temperature correction of a detection unit of the apparatus and the fusion heat of indium is used for correction of the amount of heat. An aluminum pan is used as a sample.

Preparation of Toner

Preparation of Amorphous Polyester Resin (1) and Amorphous Resin Particle Dispersion (1a)

Polyoxy ethylene (2,0)-2,2-bis(4-hydroxyphenyl) propane: 35 parts by mole

Polyoxy propylene (2,2)-2,2-bis(4-hydroxyphenyl) propane: 65 parts by mole

Terephthalic acid: 80 parts by mole n-dodecenyl succinate: 15 parts by mole

Trimellitic acid: 10 parts by mole

The above-described components and 0.05 parts by mole of dibutyl tin oxide with respect to these acid components (the total number of moles of terephthalic acid, n-dodecenyl succinate, and trimellitic acid) are added to a two-necked flask which is heated and dried, and nitrogen gas is introduced to the container to maintain an inert atmosphere and the temperature thereof is increased. Subsequently, a polycondensation reaction is performed at a temperature range of 150° C. to 230° C. for 12 hours, and the pressure is slowly reduced at a temperature range of 210° C. to 250° C., and then an amorphous polyester resin (1) is synthesized.

The weight average molecular weight (Mw) of the amorphous polyester resin (1) obtained by molecular weight measurement (polystyrene conversion) using gel permeation chromatography (GPC) is 15000 and the number average molecular weight (Mn) is 6800.

Further, when the amorphous polyester resin (1) is measured by a difference scanning calorimeter (DSC), stepwise change in the amount of the endothermic heat is observed without showing a clear peak. The glass transition temperature obtained from the intermediate point of the stepwise change in the endothermic heat amount is 62° C.

After 3000 parts of the obtained amorphous polyester resin (1), 10000 parts of ion exchange water, and 90 parts of a surfactant of sodium dodecyl benzene sulfonate are added to an emulsion tank of a high temperature and high pressure emulsion apparatus (Cavitron CD1010, slit: 0.4 mm), the resultant is heated and melted at 130° C., is then dispersed with 10,000 rotations at a flow rate of 3 L/min at 110° C. for 30 minutes, and made to pass through a cooling tank to collect the amorphous resin particle dispersion (high temperature and high pressure emulsion apparatus (Cavitron CD1010, slit: 0.4 mm)), thereby obtaining an amorphous resin particle dispersion (1a).

The volume average particle size D50v of the resin particles contained in the obtained amorphous resin particle dispersion (1a) is 0.3 μm and the standard deviation is 1.2.

Preparation of crystalline polyester resin (2) and crystalline resin particle dispersion (2a)

1,4-butanediol (manufactured by Wako Pure Chemical Industries, Ltd.): 293 parts

Dodecane dicarboxylic acid (manufactured by Wako Pure Chemical Industries, Ltd.): 750 parts Catalyst (dibutyl tin oxide): 0.3 part The above-described components are added to a three-necked flask which is heated and dried, and the air in the container is set to an inert atmosphere by nitrogen gas using an operation of reducing the pressure, and then the resultant is stirred by mechanical stirring at 180° C. for 2 hours. Subsequently, the temperature is slowly increased up to 230° C., and the resultant is stirred for 5 hours under reduced pressure and is cooled in a viscous state, and then the reaction is stopped to synthesize a crystalline polyester resin (2).

The weight average molecular weight (Mw) of the crystalline polyester resin (2) obtained by molecular weight measurement (polystyrene conversion) using GPC (gel permeation chromatography) is 18000.

Further, when the melting temperature (Tm) of the crystalline polyester resin (2) is measured using a difference scanning calorimeter (DSC) by the above-described measurement method, a clear peak is shown, and the temperature at the top of the peak is 70° C.

Further, a crystalline resin particle dispersion (2a) is prepared under the same condition as that of the resin particle dispersion (1a) except that the crystalline polyester resin (2) is used. The volume average particle size D50v of particles contained in the obtained dispersion is 0.25 μm and the standard deviation is 1.3.

Preparation of Colorant Dispersion (1)

Phthalocyanine pigment (PVFASTBLUE, manufactured by Dainichiseika Color & Chemicals Mfg. Co., Ltd.): 25 parts Anionic surfactant (Neogen RK, manufactured by DAI-ICHI KOGYO SEIYAKU CO., LTD.): 2 parts Ion exchange water: 125 parts After the above-described components are mixed with each other and dissolved, the components are dispersed using a homogenizer (Ultra-Turrax, manufactured by TKA Corp.), thereby obtaining a colorant dispersion (1).

Preparation of Release Agent Particle Dispersion (1)

Pentaerythritol behenic acid tetraester wax: 100 parts

Anionic surfactant (New Rex R, manufactured by NOF Corp.): 2 parts

Ion exchange water: 300 parts

After the above-described components are mixed with each other and dissolved, the components are dispersed using a homogenizer (Ultra-Turrax, manufactured by IKA Corp.) and then subjected to a dispersion treatment using a pressure discharging type homogenizer, thereby obtaining a release agent particle dispersion (1).

Preparation of Inorganic Particle Dispersion (1)

Hydrophobic silica (RX200, manufactured by Nippon Aerosil Co., Ltd.): 100 parts

Anionic surfactant (New Rex R, manufactured by NOF Corp.): 2 parts

Ion exchange water: 1000 parts

After the above-described components are mixed with each other and dissolved, the components are dispersed using a homogenizer (Ultra-Turrax, manufactured by IKA Corp.) and then dispersed by 200 passes using an ultrasonic homogenizer (RUS-600CCVP, NISSEI Corp.), thereby obtaining an inorganic particle dispersion (1).

Preparation of Toner (1)

Amorphous resin particle dispersion (1a): 145 parts

Crystalline resin particle dispersion (2a): 30 parts

Colorant dispersion (1): 42 parts

Release agent particle dispersion (1): 36 parts

Inorganic particle dispersion (1): 10 parts

Aluminum sulfate (manufactured by Wako Pure Chemical Industries, Ltd.): 0.5 part Ion exchange water: 300 parts The above-described components are accommodated in a round stainless steel flask, and the pH thereof is adjusted to 2.7, and then the components are dispersed using a homogenizer (Ultra-Turrax T50, manufactured by IKA Corp.), and then the resultant is heated up to 45° C. in an oil bath for heating while being stirred. When the resultant is observed using an optical microscope after being maintained at 48° C. for 120 minutes, it is verified that aggregated particles having an average particle size of 5.6 μm are formed.

Further, when the resultant is observed with an optical microscope after the resultant is kept heated and stirred at 48° for 30 minutes, it is verified that aggregated particles having an average particle size of 6.5 μm are formed. The pH of the aggregated particle dispersion is 3.2. Subsequently, the pH thereof is adjusted to 8.0 by slowly adding 1 N of a sodium hydroxide aqueous solution, and the resultant is heated up to 90° C. while continuously being stirred, and then the state is maintained for 3 hours. Next, the reaction product is filtered, and washed with ion exchange water, and then dried using a vacuum drier, thereby obtaining a toner particle (1).

The volume average particle size D50v of the obtained toner particle (1) is 6.5 μm part of gas phase silica (R972, manufactured by Nippon Aerosil Co., Ltd.) is mixed with 100 parts of the toner particles using a Henschel mixer and externally added, thereby obtaining a toner (1).

When the storage elastic modulus of the toner (1) is acquired by the above-described method, the storage elastic modulus at 65° C. G' (65) is $3\times10^7$ Pa and the storage elastic modulus at 90° C. G' (90) is $2\times10^5$ Pa. Further, the ratio G' (65)/G' (90) of the storage elastic modulus G' (65) to the storage elastic modulus G' (90) is $1.5\times10^2$.

When the SP value of the toner (1) is acquired by the above-described method, the SP value is 9.0.

Reference Example I-1

Preparation of Liquid Developer (A1)

The toner (1) obtained as described above is mixed with dimethyl silicone oil (KF-96-20cs, manufactured by Shin-Etsu Chemical Co., Ltd.) in a glass bottle to obtain a liquid developer (A1).

Reference Example 1-2

Preparation of Liquid Developer (A2)

The toner (1) obtained as described above is mixed with ethylene glycol (manufactured by Wako Pure Chemical Industries, Ltd.) in a glass bottle to obtain a liquid developer (A2).

REFERENCE COMPARATIVE EXAMPLE I-1

Preparation of Liquid Developer (B1) for Reference and Comparison

The toner (1) obtained as described above is mixed with fluidized paraffin oil (Moresco white P40, manufactured by MATSUMURA OIL Co., Ltd., flash point: 130° C.) in a glass bottle to obtain a liquid developer (B1).

Further, in regard to the above-described liquid developers A1 and A2, and the non-crosslinked liquid developer B1, a liquid developer with a concentration of 10% for evaluating the dispersibility and a liquid developer with a concentration of 30% for evaluating fixability are used.

Reference Comparative Example I-2

Preparation of Liquid Developer (B2) for Comparison

The toner (1) obtained as described above is mixed with cyclohexane (manufactured by Wako Pure Chemical Industries, Ltd.) in a glass bottle to obtain a liquid developer (B2) with a toner concentration of 10% for reference and comparison.

Reference Comparative Example I-3

Preparation of Liquid Developer (B3) for Reference and Comparison

The toner (1) obtained as described above is mixed with toluene (manufactured by Wako Pure Chemical Industries, Ltd.) in a glass bottle to obtain a liquid developer (B3) with a toner concentration of 10% for reference and comparison.

Reference Comparative Example I-4

Preparation of Liquid Developer (B4) for Reference and Comparison

The toner (1) obtained as described above is mixed with tetrahydrofuran (manufactured by Wako Pure Chemical Industries, Ltd.) in a glass bottle to obtain a liquid developer (B4) with a toner concentration of 10% for reference and comparison.

Reference Comparative Example I-5

Preparation of Liquid Developer (B5) for Reference and Comparison

The toner (1) obtained as described above is mixed with acetone (manufactured by Wako Pure Chemical Industries, Ltd.) in a glass bottle to obtain a liquid developer (B5) with a toner concentration of 10% for reference and comparison.

Reference Comparative Example I-6

Preparation of Liquid Developer (B6) for Reference and Comparison

The toner (1) obtained as described above is mixed with water in a glass bottle to obtain a liquid developer (B6) with a toner concentration of 10% for reference and comparison.

In addition, the SP values of respective carrier liquids used for liquid developers of each example and the liquid developers for reference and comparison are acquired by the above-described method. The acquired SP values and the difference (ΔSP(tc)) of SP values between the toner (1) and the carrier liquid are listed in Table 1 below.

Evaluation Test (I): Evaluation of Toner Dispersibility to Carrier Liquid

In the respective liquid developers and the respective liquid developers for comparison obtained as described above, the dispersibility of the toner (1) is evaluated visually or by performing magnification observation according to the following evaluation criteria. In addition, the present evaluation is performed after the toner is mixed with the carrier liquid and the mixture is left as it is for 1 hour. The results are listed in Table 1 below.

Dispersion: a state in which toner particles are uniformly dispersed, evaluated by visual observation and magnification observation.

Complete melting: a state in which toner particles are not observed by visual observation or magnification observation.

Aggregation: a state in which coarse particles are observed by visual observation.

Separation: a state in which the carrier liquid is completely separated from the toner particles, evaluated by visual observation.

Example 1

Preparation of Liquid Developer (1)

The toner (1) obtained as described above is mixed with dimethyl silicone oil (KF-96-20cs, manufactured by Shin-Etsu Chemical Co., Ltd.) so that the toner concentration becomes 30% to obtain a liquid developer.

Image Forming

Next, a prototype (the fixing device performs fixing in two stages, the toner image is heated in a non-contact manner by a halogen heater in the first stage, and heating and pressing are performed by a pair of heating and pressing rolls on which a blade for removing the carrier liquid is arranged in the second stage) of the image forming apparatus for liquid developing is prepared, and is filled with the obtained liquid developer (1) and a polyethylene terephthalate film (PET film: "Emblet (trade name, manufactured by Unitika Ltd.)") as a recording medium.

Further, by the image forming apparatus, development is performed by adjusting the weight of the toner (TMA) to be 3.5 g/m$^2$ and the weight of the carrier liquid (CMA) to be 3.5 g/m$^2$ when the liquid developer is transferred to the recording medium, and a fixed image is formed on the recording medium at the process speed of 80 m/min by setting the fixing conditions in the first stage, in which heating is performed at 110° in a non-contact manner and by setting the conditions of heating and pressing in the second stage in which heating is performed at 130° C. and pressing is performed at 2.7 kg/cm$^2$.

Evaluation

The following evaluations are performed on the obtained fixed image. The results are listed in Table 2.

Residual amount of carrier liquid of fixed image

The residual amount of the carrier liquid of the fixed image is measured by a thermogravimetric analyzer ("TGA-50 (trade name, manufactured by Shimadzu Corporation)"). Specifically, powder of the fixed image scraped from the recording medium is measured by the thermogravimetric analyzer and the residual amount of the carrier liquid of the fixed image is measured.

Cracks in Fixed Image

The cracks of the fixed image are evaluated by folding the fixed image, reciprocating three times a roller of a constant load (200 g), and measuring the width of the crack when the image is opened. The evaluation criteria are as follows.

G1: within 40 μm

G2: more than 40 μm and equal to or less than 60 μm

G3: more than 60 μm and equal to or less than 80 μm

TABLE 1

| | Reference Example | Reference Comparative Example | | | | | Reference Example | Reference Comparative Example |
|---|---|---|---|---|---|---|---|---|
| | I-1 | I-1 | I-2 | I-3 | I-4 | I-5 | I-2 | I-6 |
| Liquid developer | A1 | B1 | B2 | B3 | B4 | B5 | A2 | B6 |
| Carrier liquid | Dimethyl silicone | Fluidized paraffin | Cyclohexane | Toluene | Tetrahydrofuran | Acetone | Ethylene glycol | Water |
| SP value of carrier liquid [literature value] | 7.2 | 7.9 | 8.2 | 8.8 | 9.1 | 9.9 | 14.6 | 23.4 |
| SP value of toner | 9.0 | 9.0 | 9.0 | 9.0 | 9.0 | 9.0 | 9.0 | 9.0 |
| ΔSP(tc) | 1.8 | 1.1 | 0.8 | 0.2 | 0.1 | 0.9 | 5.6 | 14.4 |
| Toner dispersibility | Dispersed | Dispersed | Aggregated | Completely melted | Completely melted | Aggregated | Dispersed | Dispersed |

NG: wider than 80 μm

Peeling of Fixed Image

Peeling of the fixed image is evaluated by lightly pressing adhesive tape (cellotape (registered trademark) having a dimension of 18 mm×10 mm, manufactured by Nichiban Co., Ltd.) having an constant area against the fixed image by a finger and measuring the number of images peeled off in a spot shape when the tape is peeled off from the image. The evaluation criteria are as follows.

G1: 0

G2: from 1 to 2

G3: from 3 to 5

NG: 6 or more

Examples 2 to 8 and Comparative Examples 1 and 2

According to Table 2, a liquid developer is prepared and an image is formed using the liquid developer in the same manner as that in Example 1 except that the types of toner, carrier liquid, and recording medium are changed. In addition, evaluation is performed on the obtained fixed image. The results are listed in Table 2.

However, in Example 7, a fixed image is formed in the same manner as that of Example 1 except that the fixing of the first stage which heats the toner image by a halogen heater in a non-contact manner is not performed.

Further, in Example 8, a fixed image is formed in the same manner as that of Example 1 except that the blade for removing the carrier liquid is eliminated from the heating and pressing roll which performs the second stage fixing.

Furthermore, in Comparative Example 2, a fixed image is not obtained because the entire image flows without remaining on a film.

Hereinafter, details of Examples and Comparative Examples, and evaluation results are listed in Table 2.

From the above-described results, it is understood that, with the liquid developer using the non-volatile carrier liquid, the residual amount of the carrier liquid of the fixed image is small and the cracks and peeling of the fixed image are excellent in Examples, even when an image is formed with respect to the non-permeable recording medium when compared to Comparative Examples.

Figure 3:
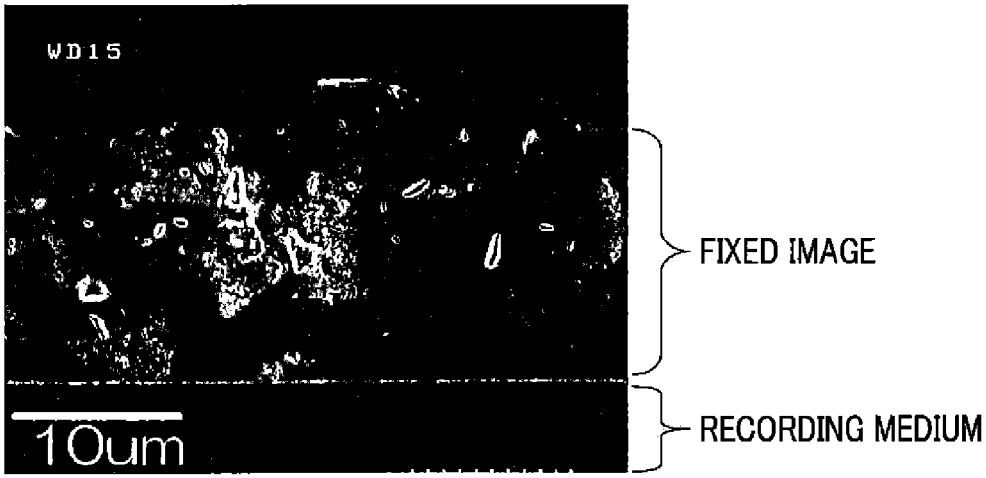
FIG. 3 is a cross-sectional image of a fixed image formed in Example 1.
Figure 4:
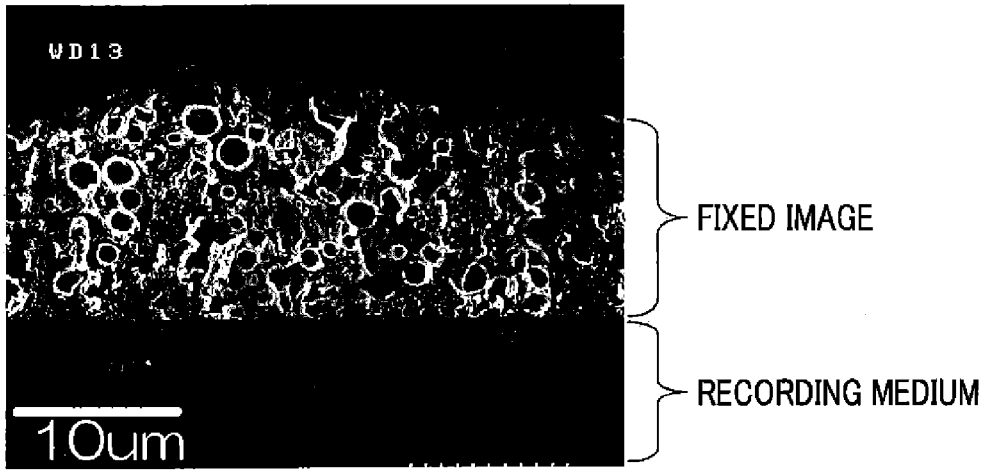
FIG. 4 is a cross-sectional image of a fixed image formed in Comparative Example 1.

Here, FIG. 3 illustrates a cross-sectional image of the fixed image formed in Example 1 and FIG. 4 illustrates a cross-sectional image of the fixed image formed in Comparative Example 1. As shown in FIGS. 3 and 4, it is understood that a precise fixed image is formed on the recording medium in the cross-sectional image of the fixed image formed in Example 1, as compared to the cross-sectional image of the fixed image formed in Comparative Example 1.

Hereinafter, the carrier liquids and the materials of the recording medium in Table 2 are described in detail.

Carrier Liquid

Silicone oil: "KF-96-20cs (trade name, manufactured by Shin-Etsu Chemical Co., Ltd.)" SP value=7.1

Ethylene glycol (manufactured by Wako Pure Chemical Industries, Ltd.), SP value=14.6

Paraffin oil: "Moresco white P40 (trade name, manufactured by MORESCO Corporation)," SP value=8.4

Recording Medium

PS film: polystyrene film "OPS film (trade name, manufactured by Asahi Kasei Chemicals Corp.)," SP value=9.1

PMMA film: methyl polymethacrylate film "ACRYPLEN (manufactured by Mitsubishi Rayon Co., Ltd.)," SP value=9.5

PVC film: polyvinyl chloride film "PVC film (trade name, manufactured by Mineron Kasei Co., Ltd.)," SP value=9.7

TABLE 2

| | | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|---|
| Carrier liquid | Type | Silicone oil | Silicone oil | Silicone oil | Silicone oil | Silicone oil | Ethylene glycol | Silicone oil | Silicone oil | Paraffin oil | Silicone oil |
| | SP value = SP(c) | 7.1 | 7.1 | 7.1 | 7.1 | 7.1 | 14.6 | 7.1 | 7.1 | 8.4 | 7.1 |
| Toner | Type | (1) | (1) | (1) | (1) | (1) | (1) | (1) | (1) | (1) | (1) |
| | SP value = SP(t) | 9.0 | 9.0 | 9.0 | 9.0 | 9.0 | 9.0 | 9.0 | 9.0 | 9.0 | 9.0 |
| Recording medium | Type | PET film | PVC film | PMMA film | 66-NY film | PS film | PET film | PET film | PET film | PET film | PTFE film |
| | SP value = SP (m) | 10.7 | 9.7 | 9.5 | 13.6 | 9.1 | 10.7 | 10.7 | 10.7 | 10.7 | 6.2 |
| ΔSP(tc) = \|SP(t) − SP(c)\| | | 1.9 | 1.9 | 1.9 | 1.9 | 1.9 | 5.6 | 1.9 | 1.9 | 0.6 | 1.9 |
| Relational expression (A) \|SP(c) − SP(m)\| > \|SP(t) − SP(m)\| Sufficiency | | Y | Y | Y | Y | Y | Y | Y | Y | Y | N |
| Evaluation | Fixed image Residual amount of carrier liquid | 0.0% | 0.0% | 0.0% | 0.0% | 0.0% | 0.0% | 0.8% | 0.0% | 3.9% | Impossible to be fixed |
| | Cracks in fixed image | G1 | G1 | G1 | G1 | G1 | G1 | G3 | G2 | NG | |
| | Peeling of fixed image | G1 | G1 | G1 | G1 | G1 | G1 | G3 | G3 | NG | |

PET film: polyethylene terephthalate film "Emblet (trade name, manufactured by Unitika, Ltd.)," SP value=10.7

66-NY film: 66-nylon film "Emblem (trade name, manufactured by Unitika, Ltd.)," SP value=13.6

PTFE film: polytetrafluoroethylene film "NITOFLON (trade name, manufactured by Nitta Denka Co., Ltd.)," SP value=6.2

In addition, the SP values of the PP film and the PET film adopt the value described in "Durability of Polymer Materials" (Industrial Committee) (1993) written by Oishi. The SP value of the PTFE film adopts values described in the "Plastic Processing Technique Handbook" edited by the Society of Polymer Science (Nikkan Kogyo Shimbun). Further, other SP values adopt values described in "Class of Polymer Chemistry, second edition" (Sankyo Publishing) written by Yujiro Sakurauchi.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an electrostatic latent image holding member;

a charging device that charges the surface of the electrostatic latent image holding member;

a latent image forming device that forms an electrostatic latent image on the surface of the electrostatic latent image holding member;

a developing device that stores a liquid developer containing a toner and a non-volatile carrier liquid, and develops the electrostatic latent image formed on the surface of the electrostatic latent image holding member by the liquid developer to form a toner image;

a transfer device that transfers the toner image onto a surface of an impermeable recording medium; and a fixing device that heats and presses the toner image transferred to the surface of the recording medium and fixes the toner image to the recording medium, wherein when the SP value of the toner is set as SP(t), the SP value of the non-volatile carrier liquid is set as SP(c), and the SP value of the recording medium is set as SP(m), an absolute value of a difference between SP(t) and SP(c) is from 1.5 to 7.0 and the following relational expression (A) is satisfied:

$$|SP(c)-SP(m)|>|SP(t)-SP(m)|, \quad \text{Relational expression (A):}$$

wherein a ration G'(65)/G'(90) of a storage elastic modulus at 65° G'(65) to a storage elastic modulus at 90° G'(90) in the toner is from $1\times10^1$ to $1\times10^3$.

2. The image forming apparatus according to claim wherein the non-volatile carrier liquid contains dimethyl silicone.

3. The image forming apparatus according to claim 1, wherein the fixing device comprises:

a first heating device that heats the toner image in a non-contact manner up to a temperature equal to or higher than a melting temperature of the toner; and a second heating and pressing device that heats the toner image while pressing the toner image at a temperature equal to or higher than the melting temperature of the toner after the heating performed by the first heating device.

4. The image forming apparatus according to claim 3, wherein the second heating and pressing device comprises:

a heating and pressing roll that heats the toner image while pressing the toner image; and a carrier liquid removing member that removes the non-volatile carrier liquid attached to the heating and pressing roll.

5. An image forming method, comprising:

charging a surface of an electrostatic latent image holding member;

forming an electrostatic latent image on the surface of the electrostatic latent image holding member;

developing the electrostatic latent image formed on the surface of the electrostatic latent image holding member by a liquid developer containing a toner and a non-volatile carrier liquid to form a toner image;

transferring the toner image to a surface of an impermeable recording medium; and fixing the toner to the recording medium by heating and pressing the toner image transferred to the surface of the recording medium, wherein when the SP value of the toner is set as SP(t), the SP value of the non-volatile carrier liquid is set as SP(c), and the SP value of the recording medium is set as SP(m), an absolute value of a difference between SP(t) and SP(c) is from 1.5 to 7.0 and the following relational expression (A) is satisfied:

$$|SP(c)-SP(m)|>|SP(t)-SP(m)|, \quad \text{Relational expression (A):}$$

wherein a ratio G'(65)/G'(90) of a storage elastic modulus at 65° G'(65) to a storage elastic modulus at 90° G'(90) in the toner is from $10^1$ to $1\times10^3$.

6. The image forming method according to claim 5, wherein the non-volatile carrier liquid contains dimethyl silicone.

7. The image forming method according to claim 5, wherein the fixing includes:

firstly heating the toner image in a non-contact manner up to a temperature equal to or higher than a melting temperature of the toner; and secondly heating the toner image while pressing the toner image at a temperature equal to or higher than the melting temperature of the toner after the heating performed in the firstly heating.

8. The image forming method according to claim 7, wherein the secondly heating is performed by a heating and pressing device including a heating and pressing roll that heats the toner image while pressing the toner image and a carrier liquid removing member that removes the non-volatile carrier liquid attached to the heating and pressing roll.

9. The image forming method according to claim 7, wherein the non-volatile carrier liquid contains dimethyl silicone.

* * * * *